US008018472B2

(12) United States Patent
King et al.

(10) Patent No.: US 8,018,472 B2
(45) Date of Patent: Sep. 13, 2011

(54) BLENDING MULTIPLE DISPLAY LAYERS

(75) Inventors: Scott Howard King, Poway, CA (US); Suhail Jalil, Poway, CA (US); Yi Liang, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 195 days.

(21) Appl. No.: 11/450,621

(22) Filed: Jun. 8, 2006

(65) Prior Publication Data

US 2007/0285439 A1 Dec. 13, 2007

(51) Int. Cl.
*G09G 5/00* (2006.01)

(52) U.S. Cl. ..... 345/638

(58) Field of Classification Search ..... 345/638
See application file for complete search history.

(56) References Cited

U.S. PATENT DOCUMENTS

| | | | | |
|---|---|---|---|---|
| 6,714,218 | B1 * | 3/2004 | Bian | 345/629 |
| 6,724,403 | B1 | 4/2004 | Santoro et al. | |
| 6,911,984 | B2 * | 6/2005 | Sabella et al. | 345/536 |
| 7,035,459 | B2 * | 4/2006 | Ishiga | 382/166 |
| 7,039,241 | B1 * | 5/2006 | Van Hook | 382/232 |
| 2001/0019336 | A1 * | 9/2001 | Gordon et al. | 345/719 |
| 2001/0056577 | A1 * | 12/2001 | Gordon et al. | 725/52 |
| 2003/0052905 | A1 * | 3/2003 | Gordon et al. | 345/700 |
| 2004/0066381 | A1 | 4/2004 | Lin et al. | |
| 2004/0133910 | A1 * | 7/2004 | Gordon et al. | 725/37 |
| 2005/0088446 | A1 * | 4/2005 | Herrick et al. | 345/531 |
| 2005/0155063 | A1 * | 7/2005 | Bayrakeri et al. | 725/47 |
| 2005/0184993 | A1 | 8/2005 | Ludwin et al. | |
| 2005/0212969 | A1 | 9/2005 | Chen | |
| 2006/0044328 | A1 | 3/2006 | Rai et al. | |

FOREIGN PATENT DOCUMENTS

| | | |
|---|---|---|
| EP | 1164571 | 12/2001 |
| WO | 0145426 | 6/2001 |

OTHER PUBLICATIONS

Suriyon Tansuriyavong, Takayuki Suzuki, Masahide Takeda and Masahiro Iwahashi; Development of a Privacy Conscious Video Communication System Using JPEG2000 Technology; 2005; 2005 Fifth International Conference on Information, Communications and Signal Processing; pp. 696-699.*

ISR/PCT/US2007/069561 Mailed Feb. 19, 2008.

Written Opinion—PCT/US2007/069561, International Search Authority, European Patent Office, Feb. 19, 2008.

* cited by examiner

*Primary Examiner* — Jeffery A Brier
(74) *Attorney, Agent, or Firm* — John Rickenbrode

(57) ABSTRACT

Image processing techniques are described that reduce the amount of bandwidth required to read an image from memory for display. According to the techniques, a processor stores low change rate display layers in a memory such that a processor can read the display layers from the memory using a reduced amount of processing resources. An overlay module blends low change rate display layers into a combined overlay layer. A processor reads the overlay layer from the memory and selectively processes the overlay layer based on processing information for the overlay layer recorded in memory. The processor then blends the overlay layer and a high change rate video display layer to update a single image for display according to a high change rate. In addition, the overlay module updates the overlay layer based on the low change rate display layers according to a low change rate.

47 Claims, 11 Drawing Sheets

BLENDING MULTIPLE DISPLAY LAYERS

TECHNICAL FIELD

This disclosure relates to video processing techniques and, more particularly, video processing techniques for multiple display layers.

BACKGROUND

A Mobile Display Processor (MDP) blends multiple layers to compose a single image to be sent to a display within a wireless communication device (WCD). Some example WCDs include cellular or satellite radiotelephones, radiotelephone base stations, computers that support one or more wireless networking standards, wireless access points for wireless networking, PCMCIA cards incorporated within portable computers, direct two-way communication devices, personal digital assistants (PDAs) equipped with wireless communication capabilities, and the like.

Several different applications operating within the WCD may send information to the display at any given time. For example, a system application may send a signal strength indicator to the display while a video application may send decoded video. In some cases, the same application may send multiple display items to the display at the same time. The video application, for example, may send the decoded video plus a video counter and video control buttons. The video application may also send a decorative border that frames the decoded video. As another example, the system application may send the signal strength indicator plus a clock to the display. Each of the display items sent by the applications operating within the WCD may comprise a separate display layer.

Typically, only one of the display layers sent from the applications to the display changes at a high rate, such as the decoded video from the video application operating within the WCD. For example, the decoded video may change at a rate of approximately 30 frames per second. The remaining display layers sent to the display may change at a much lower rate or never change. For example, the time-of-day information and video counter may change at a rate of approximately 1 frame per second. In addition, only small sub-sections of the slowly changing display layers may change.

The MDP blends the different display layers together to form a single image for the display, and updates the single image according to the rate of the fastest changing display layer. For example, if the decoded video changes at a rate of approximately 30 frames per second, the MDP reads in and blends all of the display layers at the rate of approximately 30 frames per second. Reading all of the display layers from a memory within the WCD at a high rate may require a large amount of bandwidth.

SUMMARY

In general, the disclosure relates to image processing techniques that reduce the amount of bandwidth required to read an image from a memory for display. According to the disclosed image processing techniques, a processor stores low change rate display layers in a memory such that a processor can read the display layers from the memory using a reduced amount of processing resources. The techniques reduce the number of low change rate layers that must be read from memory in order to update a displayed image. In some embodiments, the techniques may be implemented in a wireless communication device (WCD).

For example, the image processing techniques blend low change rate display layers into a combined overlay layer and store the overlay layer in a memory. In some embodiments, the overlay layer may be stored as a plurality of tiles including headers. An overlay module records processing information for the tiles in the headers. To prepare an image, a processor reads in and processes a high change rate display layer, such as a decoded video display layer, according to a high change rate. Instead of reading in multiple layers of low change rate information, however, the processor reads in the combined overlay layer.

The processor reads in the tiles in the overlay layer from the memory and selectively processes the tiles based on the processing information recorded in the headers according to the high change rate. Each non-transparent tile in the overlay layer is then blended with a corresponding tile in the high change rate display layer to update a display image. In this way, using a combined overlay layer, the amount of processing resources used to read the low change rate layers from the memory into the processor and update the display image according to the high change rate is reduced.

In addition, the image processing techniques enable the overlay module to update the overlay layer based on the low change rate display layers according to a low change rate. The image processing techniques may include storing the tiles in the overlay layer as fixed size records with fixed size headers in the memory. The overlay module may determine which tiles include changing display items and locate the changing tiles stored in the memory based on the fixed size records. The overlay module may then update only the changing tiles in the overlay layer according to the low change rate. In this way, the amount of processing resources used to update the overlay layer with the overlay module according to the low change rate is reduced.

In one embodiment, the disclosure provides a method comprising combining two or more display layers to form an overlay layer, selectively processing the overlay layer based on processing information for the overlay layer recorded in memory, and combining the overlay layer with a video layer to form an image for presentation on a display device. The method also comprises updating the image at a first change rate corresponding to a change rate associated with the video layer, and updating the overlay layer at a second change rate lower than the first change rate.

In another embodiment, the disclosure provides a computer-readable medium comprising instructions. The instructions cause a programmable processor to combine two or more display layers to form an overlay layer, selectively process the overlay layer based on processing information for the overlay layer recorded in memory, and combine the overlay layer with a video layer to form an image for presentation on a display device. The instructions further cause the programmable processor to update the image at a first change rate corresponding to a change rate associated with the video layer, and update the overlay layer at a second change rate lower than the first change rate.

In another embodiment, the disclosure provides a system comprising an overlay module that combines two or more display layers to form an overlay layer. The system also comprises a processor that selectively processes the overlay layer based on the processing information for the overlay layer recorded in a memory, combines the overlay layer with a video layer to form an image for presentation on a display device, and updates the image at a first change rate corresponding to a change rate associated with the video layer. The overlay module updates the overlay layer at a second change rate lower than the first change rate.

In a further embodiment, the disclosure provides a method comprising combining two or more display layers to form an overlay layer, storing the overlay layer in a memory as a plurality of tiles including headers, recording processing information for each of the plurality of tiles in headers of the respective tiles, selectively processing the plurality of tiles in the overlay layer based on the processing information recorded in the headers of the plurality of tiles, and combining the overlay layer with a video layer to form an image for presentation on a display device.

The method also comprises updating the image at a first change rate corresponding to a change rate associated with the video layer, wherein updating the image comprises reading the overlay layer from the memory, selectively processing the plurality of tiles in the overlay layer based on the processing information recoded in the headers of the plurality of tiles, and recombining the overlay layer with the video layer according to the first change rate. In addition, the method includes updating the overlay layer at a second change rate lower then the first change rate, wherein updating the overlay layer comprises reading the two or more display layers from the memory and recombining the display layers according to the second change rate.

The techniques described herein may be implemented in hardware, software, firmware, or any combination thereof. If implemented in software, the techniques may be realized in whole or in part by a computer readable medium comprising instructions that, when executed by a processor, performs one or more of the methods described herein.

The details of one or more embodiments are set forth in the accompanying drawings and the description below. Other features, objects, and advantages of the invention will be apparent from the description and drawings, and from the claims.

DETAILED DESCRIPTION

Figure 1:
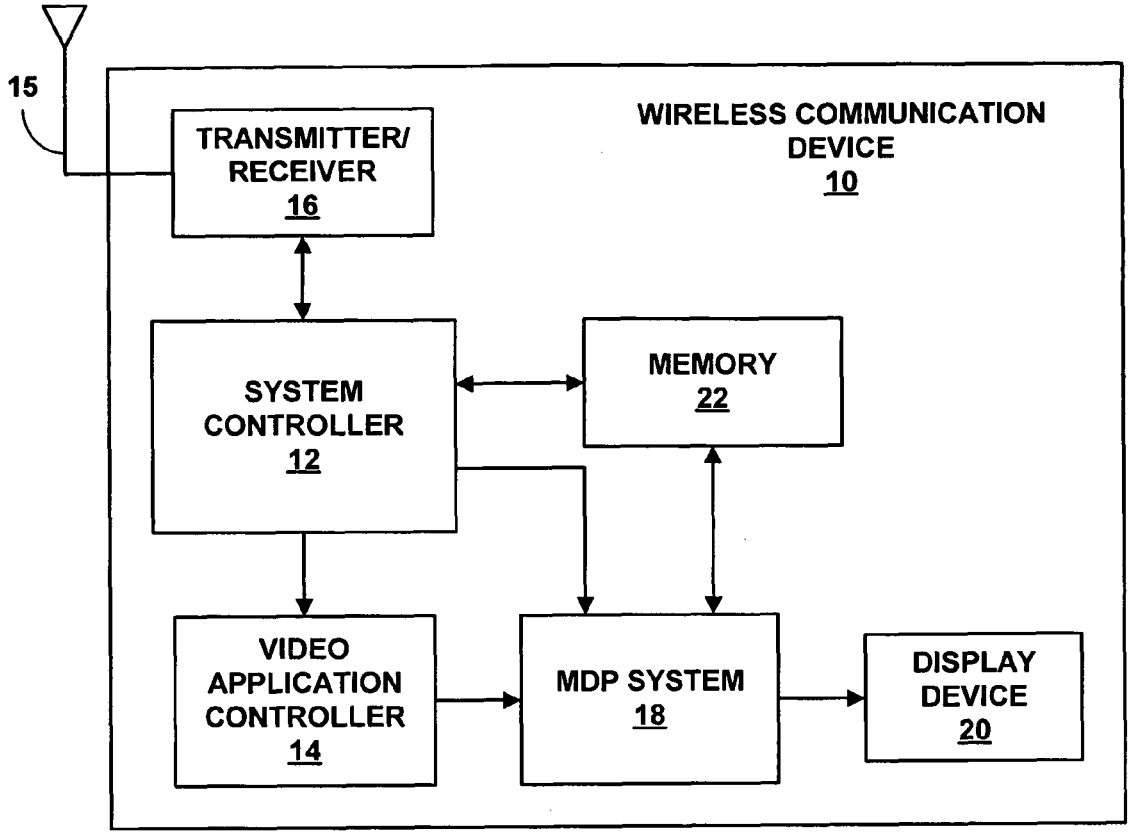
FIG. 1 is a block diagram illustrating an exemplary wireless communication device (WCD) including a mobile display processor (MDP) system that implements imaging processing techniques that reduce the amount of bandwidth required to read images from a memory.

FIG. 1 is a block diagram illustrating an exemplary wireless communication device (WCD) 10 including a mobile display processor (MDP) system 18 that implements image processing techniques that reduce the amount of bandwidth required to read an image for display from a memory 22. In the example of FIG. 1, MDP system 18 resides within WCD 10, which may take the form of a mobile radiotelephone, a satellite radiotelephone, a wireless communication card incorporated within a portable computer, a personal digital assistant (PDA) equipped with wireless communication capabilities, or any of a variety of devices capable of wireless communication. In other embodiments, MDP system 18 may be used in other devices, including wired communication device and device not principally directed to communication.

WCD 10 may communicate with a plurality of base stations. The base stations are generally stationary equipment that wirelessly communicate with WCD 10 in order to provide network access to WCD 10. For example, the base stations may provide an interface between WCD 10 and a public switched telephone network (PSTN) such that telephone calls can be routed to and from WCD 10. Alternatively, or additionally, the base stations may be coupled to a packet-based network for transmission of packet-based voice information or packet-based data.

In the example of FIG. 1, WCD 10 includes a system controller 12, video application controller 14, an antenna 15, a transmitter/receiver 16, MDP system 18, a display device 20, and a memory 22. System controller 12 may comprise a mobile station modem (MSM) capable of controlling operation of WCD 10. Transmitter/receiver 16 receives wireless signals from the base stations via antenna 15. The wireless signals are then sent to system controller 12 for processing and/or storage in memory 22. For example, upon receiving a voice signal, system controller 12 may immediately process the voice signal such that a user of WCD 10 may listen to the voice signal. As another example, upon receiving video data, system controller 12 may store the video data in memory 22 until the user of WCD 10 wants to view the video data. In other embodiments, system controller 12 may receive video data from a video capture device, such as a digital camcorder, included within WCD 10.

Display device 20 may comprise a liquid crystal display (LCD), a cathode ray tube (CRT) display, a plasma display, or another type of display device. An image for presentation on display device 20 may include multiple display layers from several different applications operating within WCD 10. For example, when the user of WCD 10 wants to view the received video, system controller 12 may retrieve the stored video data from memory 22 and send the video data to video application controller 14. Video application controller 14 decodes the video data and prepares the decoded video as a video display layer.

Video application controller 14 may send the video display layer to MDP system 18 to be processed for display on display device 20. Video application controller 14 may also send a video counter and video control buttons as a video control display layer, and a decorative border that frames the decoded video as a border display layer to MDP system 18. System controller 12 may send a signal strength indicator, a network status indicator, and a time and/or date as a system status display layer to MDP system 18.

Typically, only one of the display layers sent from system controller 12 and video application controller 14 to MDP system 18 for display changes at a high rate. In particular, the video display layer from video application controller 14 may include decoded data that is updated at a high frame rate. For example, in some applications, the decoded video in the video display layer may change at a rate of approximately 30 frames per second. The remaining display layers sent to MDP processor 18 for display may change at a much lower rate or never change. In some cases, only small sub-sections of the low change rate display layers may change. For example, a time clock included in the system status display layer and a video counter included in the video control display layer may change at a rate of 1 frame per second. A date indication may only change once per day. A signal strength indicator included in the system status display layer may only change when the signal strength received by WCD 10 changes. In addition, video control buttons included in the video control display layer and a decorative border included in the border display layer may not change during display of the decoded video.

MDP system 18 blends the low change rate display layers together to form a combined overlay layer. Multiple low change rate display layers may be combined to form a single overlay layer. Alternatively, in other embodiments, different sets of low change rate display layers may be combined to form different overlay layers. However, generation of a single overlay layer will ordinarily be desirable. The image processing techniques described herein include storing the overlay layer in memory 22 such that MDP system 18 can read the overlay layer from memory 22 using a reduced amount of processing resources, in comparison to reading and processing each of the low change rate display layers individually.

MDP system 18 then blends the overlay layer and the video display layer to update the image for display according to the high change rate of the video display layer. Hence, MDP system 18 updates the image at the high change rate of the video display layer, but combines the low change rate display layers in the overlay layer to avoid updating each individual low change rate layer at the high change rate. In addition, MDP system 18 updates the overlay layer based on the low change rate display layers according to a low change rate of the display layers. In this way, the image processing techniques substantially reduce the amount of bandwidth required to read the image from memory 22 for display on display device 20.

Figure 2:
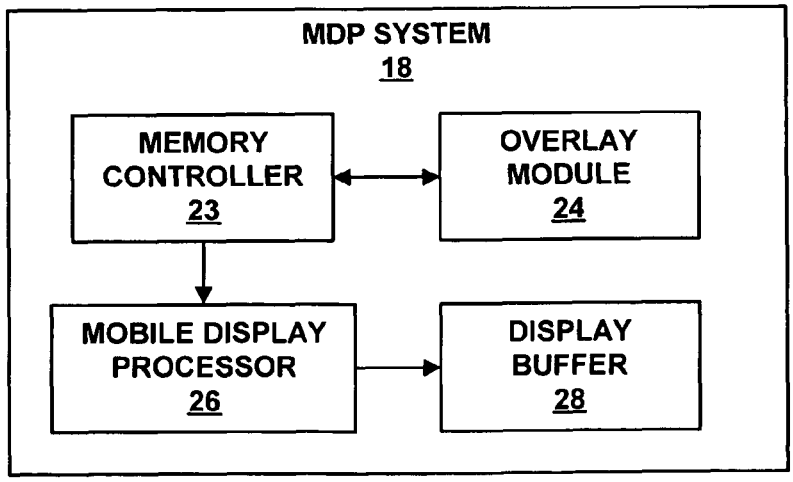
FIG. 2 is a block diagram illustrating the MDP system from FIG. 1 in greater detail.

FIG. 2 is a block diagram illustrating MDP system 18 from FIG. 1 in greater detail. MDP system 18 includes a memory controller 23, an overlay module 24, a mobile display processor (MDP) 26 and a display buffer 28. MDP system 18 includes overlay module 24 to store low change rate display layers in memory 22. Overlay module 24 combines two or more low change rate display layers such that MDP 26 can read multiple low change rate display layers from memory 22, via memory controller 23, as a combined overlay layer. In this manner, MDP 26 uses a reduced amount of processing resources to read the display layers from memory 22. MDP 26 blends the multiple low change rate display layers received from system controller 12 combined in the overlay layer with the high change rate display layer or layers received from video application controller 14 to compose a single image to be sent to display device 20 via display buffer 28.

In the case where display device 20 comprises an LCD, display device 20 updates the displayed imagery on a row-by-row basis starting at the top row and proceeding to the bottom row of display device 20. The update operation reads image data out of display buffer 28 within MDP system 18 and places the image data on display device 20. A read pointer within display buffer 28 indicates the particular row that display device 20 is updating at a particular point by pointing to a location in display buffer 28 that is being read to display device 20 at the same point in time.

If a user of WCD 10 is viewing high change rate video (e.g., a movie or graphics from a video game) on display device 20, then care must be taken to prevent a phenomenon known as "tearing" from taking place. Tearing occurs when a write pointer pointing to a location in display buffer 28 that is being written with new video content crosses the read pointer. When this occurs, a top portion of display device 20 will be showing frame n while a bottom portion of display device 20 is showing frame n+1. A well known technique for preventing tearing in a system with a single display buffer, e.g., display buffer 28, is known as "following the beam." This technique updates the contents of display buffer 28 immediately after the video content is sent to display device 20.

Sometimes the video content in frame buffer 28 needs to be rotated prior to going to display device 20. An example of this requirement is when a user of WCD 10 wants to watch a movie in wide screen format on a portrait mode display. The video content is stored in memory 22 in a row-by-row format. To be rotated, the video content has to be sent to display device 20 via MDP system 18 in a column-by-column fashion. Memory controller 23 reads bursts of contiguous data, so this method of rotation is inefficient. However, MDP 26 within MDP system 18 has the ability to access video content in a tile-by-tile fashion. By accessing the video content in tiles, memory controller 23 is allowed to import a long burst of pixels for each row of the non-rotated tile. MDP 26 then efficiently rotates the tile internally.

In order to follow the beam, MDP 26 fetches the first column of tiles in the non-rotated image from memory 22 via memory controller 23. As the first tile is read, MDP 26 efficiently rotates and stores the first tile in display buffer 28. Once the entire first column of tiles in the non-rotated image has been rotated and stored in display buffer 28, the first row of tiles of the rotated image may be sent to display device 20.

The image processing techniques described herein enable overlay module 24 within MDP system 18 to blend two or more low change rate display layers (e.g., the video control layer, the system status layer, and the border layer) into a combined overlay layer. MDP 26 then reads and processes the overlay layer, instead of the multiple low change rate display layers, to update the image for display on display device 20. In some embodiments, multiple overlay layers may be produced using different subsets of low change rate display layers. However, generation of a single overlay layer will ordinarily be desirable.

In an exemplary embodiment, overlay module 24 stores the overlay layer in memory 22 as a plurality of tiles including headers. Overlay module 24 records processing information for each of the tiles in their respective headers. A header of a current tile may include the number indicating the order or position of the current tile among the other tiles within the overlay layer. The header may also include a tile status that indicates transparency of the current tile and adjacent tile status that indicates transparency of a number of adjacent tiles in the overlay layer. A tile may be considered substantially transparent if the tile contains substantially no image content. In addition, the header may include a compression type of the current tile that indicates the technique used to transform the data in the tile to reduce an amount of memory required to store the data. The compression types may relate to run-length encoding (RLE) compression types that include component basis compression and pixel basis compression, or no compression. Finally, the header may include a burst length of the next tile in the overlay layer that indicates the number of bytes of data in the next tile to read in one group or "burst" such that the entire next tile may be read in a known number of bursts. In some cases, the burst length of the next tile may comprise the burst length of the next non-transparent tile in the overlay layer.

MDP 26 reads in and processes the high change rate video display layer from video application controller 14 according to the high change rate. MDP 26 also reads the overlay layer from memory 22 and selectively processes the plurality of tiles in the overlay layer based on the processing information recorded in the headers according to the high change rate. The overlay layer is then blended with the high change rate video display layer to form a single image for display on display device 20 within WCD 10.

For example, MDP 26 may read status of a current tile and status of adjacent tiles recorded in the header of the current tile. The status may comprise an indicator of whether the current tile is substantially transparent and a number, if any, of adjacent tiles that are also substantially transparent. A tile is substantially transparent if the tile contains substantially no image content. If a tile is transparent, then it is intended to permit unobscured viewing of the underlying high change rate video layer. MDP 26 may skip reading and processing of those tiles indicated to be substantially transparent, as they will have no impact on the ultimate image that combines the high change rate video layer with the low change rate layers in the overlay layer.

In this way, MDP 26 only needs to process a portion of the tiles in the overlay layer, which reduces the amount of bandwidth required to read the overlay layer from memory 22 into MDP 26 according to the high change rate. Hence, even though the low change rate information is still processed at the high change rate dictated by the video layer, combination of multiple layers into a single overlay layer and intelligent tile processing substantially reduces the processing resources required to produce the ultimate image to be displayed.

As another processing feature, overlay module 24 may store rows of pixels, or "pixel strips," within each of the plurality of tiles in the overlay layer in successive memory locations that are not separated by line strides. Overlay module 24 may then perform efficient run-length encoding (RLE) on at least a portion of the plurality of tiles in the overlay layer and record the type of compression used for each of the tiles in the headers of the tiles stored in memory 22. In this way, MDP 26 may read compressed tiles from memory 22, which further reduces the amount of bandwidth required to read the image from memory 22 into MDP 26, particularly when updates occur at the high change rate required by the video layer. MDP 26 may then decompress the tiles for processing according to the compression type recorded in the headers of the tiles.

Overlay module 24 may also record burst lengths of the next tile, or the next non-transparent tile, for each of the tiles in the headers of the tiles stored in memory 22. In this way, MDP 26 may determine ahead of time how many bursts to perform to read a specific tile from memory 22, which reduces latency when processing the overlay layer for display.

In addition, overlay module 24 updates the overlay layer based on the low change rate display layers according to a low change rate. Overlay module 24 may store the tiles in the overlay layer as fixed size records with fixed size headers in memory 22. In other words, each tile may have the same, fixed size. Overlay module 22 may then determine which tiles include changing display items and locate the changing tiles stored in memory 22 based on the fixed size records. In this way, overlay module 24 only needs to update the changing tiles in the overlay layer, which reduces the amount of bandwidth required to update the overlay layer with overlay module 24 according to the low change rate.

Figure 3:
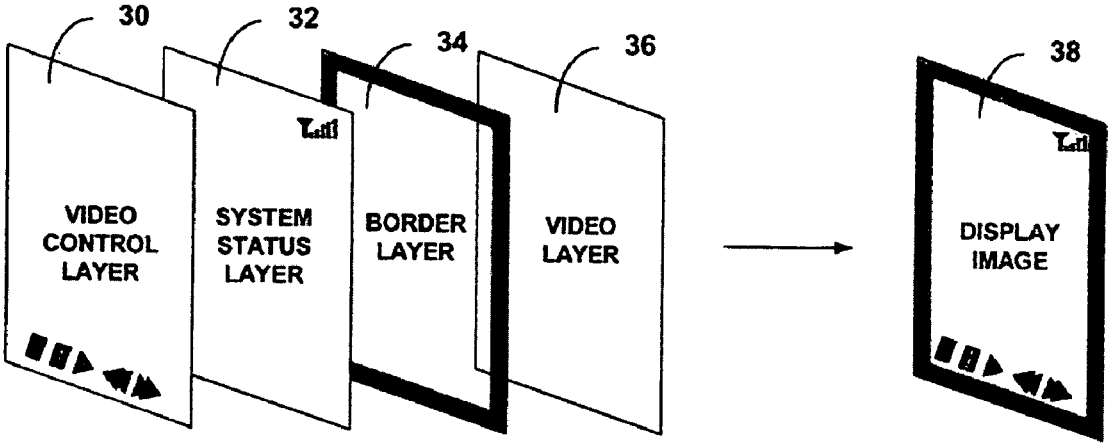
FIG. 3 PRIOR ART
FIG. 3 illustrates a conventional operation of blending display layers together to form a single display image for display in a WCD.

FIG. 3 illustrates a conventional operation of blending display layers together to form a single display image 38 for display in a WCD. In the illustrated example, a video control layer 30, a system status layer 32, a border layer 34, and a video layer 36 are combined to form display image 38. Typically, only video layer 36 changes at a high rate, and the remaining display layers change at much lower rates or never change. In the conventional operation illustrated in FIG. 3, however, a MDP blends all the display layers together to update display image 38 according to the rate of the fastest changing display layer. Reading all the display layers from memory at a high rate may require a large amount of bandwidth, and is inefficient given the fact that many of the layers change at a very low change rate.

As shown in FIG. 3, the background layer is video layer 36, which includes decoded video. On top of video layer 36 is border layer 34 including a decorative border that is at least partially opaque and a viewing area for video layer 38 that is completely transparent. The next layer is system status layer 32 including a signal strength indicator that represents the signal strength received by the WCD. System status layer 32 may also include a clock (not shown) that presents time-of-day information and/or date information. The small sub-sections of system status layer 32 that include display items may be at least partially opaque, and the remaining sections of system status layer 32 may be completely transparent in order to view video layer 36. The final layer is video control layer 30 including video control buttons that enable a user of the WCD to control the playback of the decoded video in video layer 36. Video control layer 30 may also include a video counter (not shown) that presents time-of-video information. Similar to system status layer 32, the small sub-sections of video control layer 30 that include display items may be at least partially opaque, and the remaining sections of video control layer 30 may be completely transparent in order to view video layer 36.

Each of the display layers 30, 32, 34 and 36 may change at a different rate. For example, video layer 36 may change at a high rate, e.g., approximately 30 frames per second. Border layer 34 may not change during display of the decoded video. System status layer 32 may change at a low rate, e.g., approximately 1 frame per second or when the signal strength received by the WCD changes. Video control layer 30 may change at a low rate, e.g., approximately 1 frame per second, or may not change during display of the decoded video. The amount of data that is changing on system status layer 32 and video control layer 30 is generally very minimal, such as the last digit of the video counter, the seconds on the time display, or the number of bars of the signal strength indicator. In the conventional operation, if video layer 36 changes at a rate of approximately 30 frames per second, the MDP reads in and blend all the display layers 30, 32, 34 and 36 at the rate of approximately 30 frames per second, regardless of the change rates of the individual display layers.

TABLE 1

| Format | MBps for 30 frames per second |
|---|---|
| Video | 15 |
| 2 Bpp graphics | 18 |
| 3 Bpp graphics | 26 |
| 4 Bpp graphics | 35 |
| Sum | 94 |

The bandwidth required to read the individual display layers from memory to a processor can be quite large. Table 1 given above illustrates an amount of bandwidth in Mega Bytes per second (MBps) required to pass various data formats from a memory into a MDP at 30 frames per second for a video graphics array (VGA) sized display layer. A typical VGA display layer may by 40 tiles by 30 tiles or, in the case where each tile is a 16-by-16 block of pixels, 640 pixels by 480 pixels. The display layer formats include a video format and formats with increasing numbers of Byte per pixel (Bpp) graphics. In the case where display image 38 includes one layer from each of the video, 2 Bpp graphics, 3 Bpp graphics, and 4 Bpp graphics data formats, the total bandwidth required to update display image 38 using the individual display layers with the MDP at 30 frames per second is approximately 94 MBps.

TABLE 2

| Format | Bytes/16 pixels | Cycles/16 pixels | Efficiency |
|---|---|---|---|
| Video | 48 | 46 | 78% |
| Luma | 16 | 22 | 55% |
| Chroma | 32 | 24 | 100% |
| 2 Bpp graphics | 32 | 24 | 100% |
| 3 Bpp graphics | 48 | 46 | 78% |
| 4 Bpp graphics | 64 | 48 | 100% |

In addition, optimal memory or bus access is not necessarily the same size as the matching dimension of a tile in each of the individual display layers for the different data formats. For example, the cost of reading 32 bytes is approximately 24 bus cycles. The cost of reading 16 bytes is less, but only by approximately two cycles. In other words, for the cost of two more bus cycles the amount of data read in could be doubled, but there is no reason to read in data beyond the tile dimension. The efficiency of reading 16 bytes compared to reading 32 bytes is approximately 55%. Table 2 given above shows the bus/memory efficiency of reading tiles with rows of 16 pixels for individual display layers of various data formats. As can be seen from Table 2, there will be some bandwidth overhead beyond the 94 MBps needed to update display image 38 using the individual display layers with the MDP.

Figure 4:
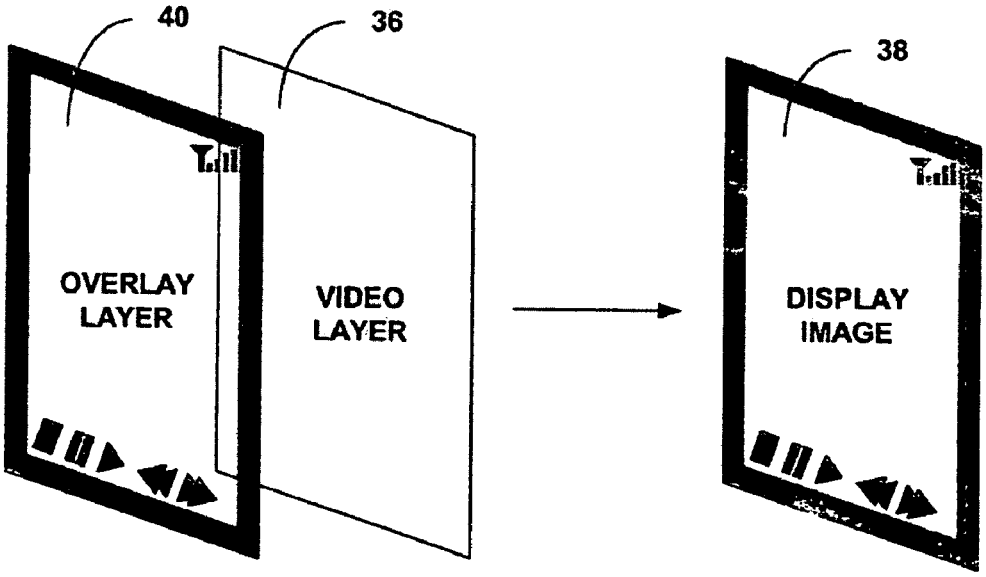
FIG. 4 illustrates an exemplary operation of blending two or more low change rate display layers together to form a combined overlay layer, and then combining the overlay layer with a high change rate video layer to form a single display image for display on a display device.

FIG. 4 illustrates an exemplary operation of blending two or more low change rate display layers together to form a single overlay layer 40, and then combining overlay layer 40 and video layer 36 to form single display image 38 for display on display device 20 within WCD 10. For example, video control layer 30, system status layer 32, and border layer 34 from FIG. 3 may be combined to form overlay layer 40. In other embodiments, more or less low change rate display layers that include different display items may be blended to form overlay layer 40. Also, multiple overlay layers may be formed, although a single overlay layer will ordinarily be desirable. MDP 26 may read in and blend overlay layer 40 and video layer 36 together to update display image 38 according to the high change rate of video layer 36. Overlay module 24 may read in and blend low change rate display layers 30, 32 and 34 together to update overlay layer 40 according to a low change rate of the display layers. In this way, the amount of bandwidth required to update display image 38 may be substantially reduced relative to the conventional operation described in reference to FIG. 3.

As shown in FIG. 4, the background layer is video layer 36 including decoded video from video application controller 14. On top of video layer 36 is overlay layer 40 including display items from border layer 34, system status layer 32, and video control layer 30. The small sub-sections of overlay layer 40 that include display items may be at least partially opaque, and the remaining sections of overlay layer 40 may be completely transparent in order to view video layer 36.

Overlay layer 40 and video layer 36 change at different rates. For example, video layer 36 may change at a high rate, e.g., approximately 30 frames per second. Overlay layer 40 may change at a low rate, e.g., approximately 1 frame per second. In addition, the amount of data that is changing on overlay layer 40 is generally very minimal, such as the last digit of the video counter, the seconds on the time display, or the number of bars of the signal strength indicator. In the exemplary operation, if video layer 36 changes at a rate of approximately 30 frames per second and overlay layer 40 changes at a rate of approximately 1 frame per second, MDP 26 reads in and blends overlay layer 40 and video layer 36 to update display image 38 at the rate of approximately 30 frames per second. Furthermore, overlay module 24 reads in and blends display layers 30, 32, and 34 to update overlay layer 40 at the rate of approximately 1 frame per second.

Overlay module 24 may save overlay layer 40 in a 4 Bpp data format due to the different shading used for each of display layers 30, 32 and 34 that make up overlay layer 40. Blending the low change rate display layers to form overlay layer 40 using overlay module 24 reduces the amount of bandwidth required to update display image 38 using overlay layer 40 with MDP 26 at 30 frames per second from approximately 94 MBps to approximately 50 MBps. From Table 1, updating video layer 36 at 30 frames per second requires approximately 15 MBps and updating overlay layer 40 in a 4 Bpp graphics format at 30 frames per second requires approximately 35 MBps.

A side effect of forming overlay layer 40 with overlay module 24 is an increased amount of bandwidth required to read the low change rate display layers 30, 32 and 34 from memory 22 into overlay module 24, and then write overlay layer 40 back into memory 22. The total bandwidth required to update and write overlay layer 40 with overlay module 24 at 1 frame per second is approximately 4 MBps. From Table 1, updating three display layers, each conforming to a different data format, at 1 frame per second requires approximately 18+26+35 MBps divided by 30, and writing overlay layer 40 at 1 frame per second requires approximately 35 MBps divided by 30. Therefore, the total amount of bandwidth required to update display image 38 using overlay layer 40 according to a high rate of change is approximately 54 MBps, which is substantially less than the amount required to read all of the low change rate display layers individually.

Figure 5:
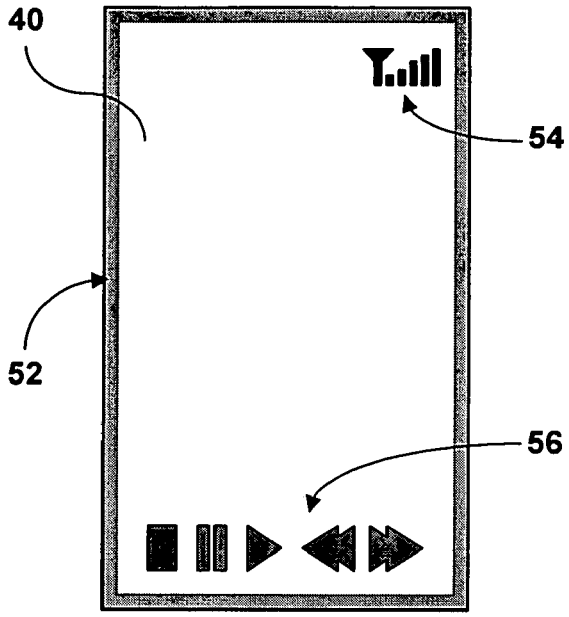
FIG. 5 illustrates an exemplary overlay layer that combines low change rate display layers from a system controller and a video application controller within a WCD.

FIG. 5 illustrates exemplary overlay layer 40 that combines low change rate display layers from system controller 12 and video application controller 14 within WCD 10. As described above, overlay layer 40 may be placed over video layer 36 to form the image for display on display device 20 in WCD 10.

For example, video control layer 30, system status layer 32, and border layer 34 may be combined to form overlay layer 40. Overlay layer 40 includes a decorative border 52 from border layer 34, a signal strength indicator 54 from system status layer 32, and video control buttons 56 from video control layer 30. The small sub-sections of overlay layer 40 that include display items may be at least partially opaque, and the remaining sections of overlay layer 40 may be completely transparent in order to view video layer 36 when displayed on display device 20. As mentioned previously, in various embodiments, overlay layer 40 also may include clock information, date information, network status information, or any of a variety of other information taken from additional layers.

Figure 6:
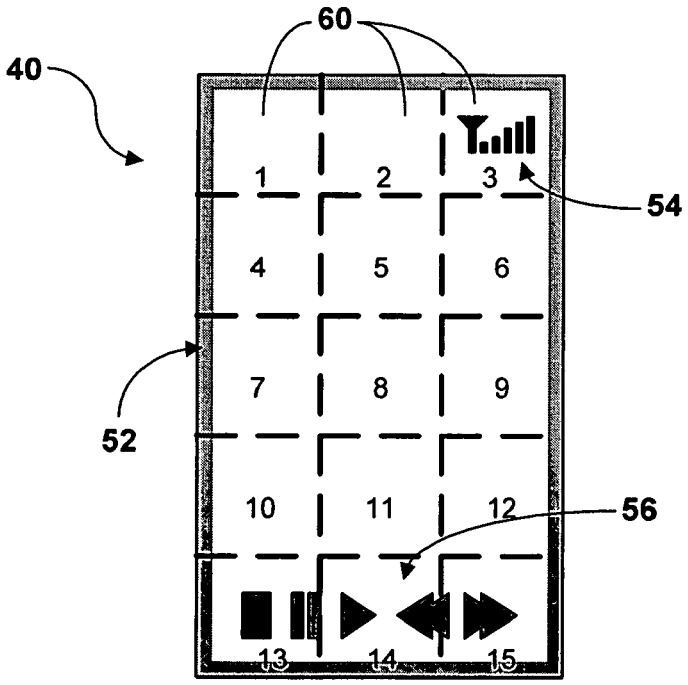
FIG. 6 illustrates the overlay layer from FIG. 5 divided into a plurality of tiles.

FIG. 6 illustrates overlay layer 40 from FIG. 5 divided into a plurality of tiles 60. For purposes of illustration, FIG. 6 shows only fifteen tiles 60 in overlay layer 40. However, a VGA sized overlay layer is typically 40 tiles by 30 tiles for a total of 1200 tiles in the overlay layer. Each of tiles 60 in overlay layer 40 may include a 16-by-16 block of pixels or a 32-by-32 block of pixels. MDP 26 processes the background video layer 36 on a tile-by-tile basis from video application controller 14 to allow efficient rotation as described in reference to FIG. 2. Therefore, MDP 26 also processes overlay layer 40 from memory 22 on a tile-by-tile basis. The numbering of tiles 60 shows the order in which MDP 26 will process overlay layer 40.

As can be seen, overlay layer 40 includes some tiles 60 that do not include display items, such as decorative border 52, signal strength indicator 54, and video control buttons 56. Tiles 60 without display items may be completely transparent. In a VGA sized overlay layer, the decorative border may be present in about 10% of the tiles, and any remaining display items will typically occupy another 10% of the tiles. Therefore, approximately 80% of the tiles in the VGA sized overlay layer will be completely transparent.

Figure 7:
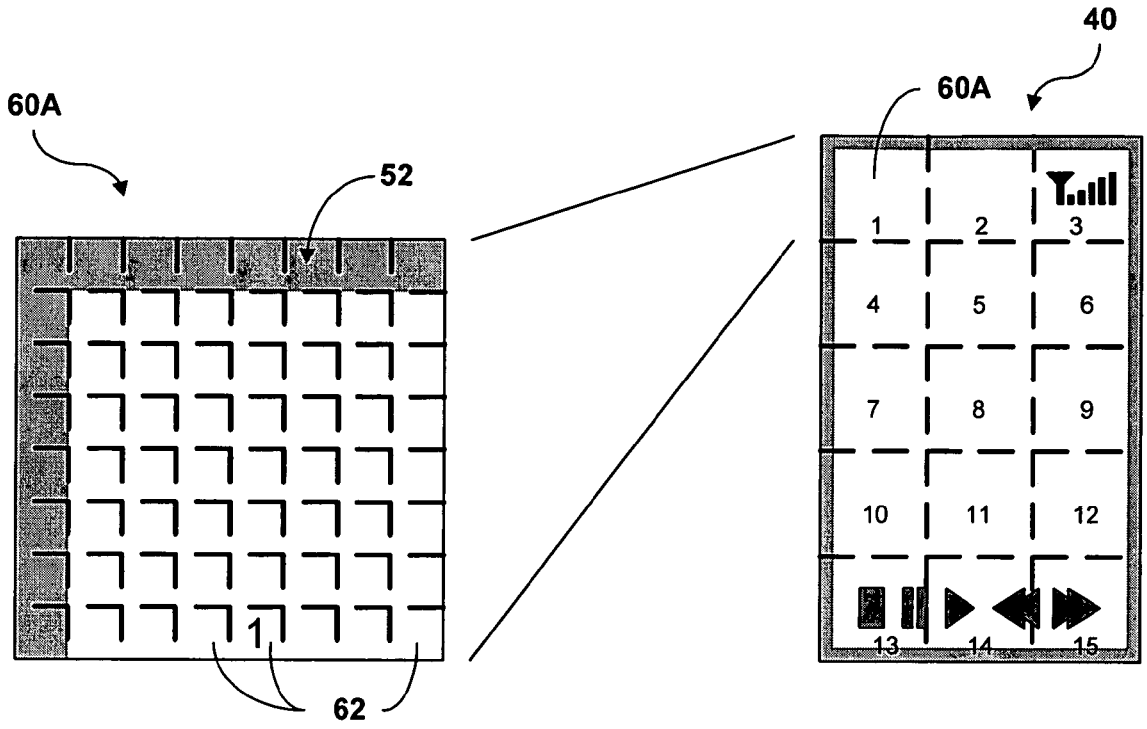
FIG. 7 illustrates a single tile in the overlay layer from FIG. 5 in greater detail.

FIG. 7 illustrates a single tile 60A in overlay layer 40 in greater detail. Each of tiles 60 in overlay layer 40 may be substantially similar to tile 60A. Tile 60A comprises a two dimensional array of pixels 62. For purposes of illustration, FIG. 7 shows tile 60A being 8 pixels by 8 pixels in size. However, a VGA sized overlay layer typically has tiles that are 16 pixels by 16 pixels or 32 pixels by 32 pixels in size. In the illustrated embodiments, tile 60A is a border tile in overlay layer 40 that includes a portion of decorative border 52 from border layer 34. Tile 60A has large areas that are either the same value, i.e., decorative border 52, or are completely transparent, which lends well to RLE.

As described above, upon forming overlay layer 40, overlay module 24 stores overlay layer 40 in memory 22 as plurality of tiles 60 including headers. Overlay module 24 records processing information for the plurality of tiles 60 in the headers. For example, a header of tile 60A may include the tile number of current tile 60A in overlay layer 40, a tile status that indicates transparency of current tile 60A, and adjacent tile status that indicates transparency of a number of adjacent tiles in overlay layer 40.

MDP 26 reads overlay layer 40 from memory 22 and selectively processes plurality of tiles 60 in overlay layer 40 based on the processing information recorded in the headers according to the high change rate. MDP 26 reads in and processes the high change rate video display layer 36 from video application controller 14 according to the high change rate. During processing, MDP 26 combines each non-transparent tile in overlay layer 40 with a corresponding tile in video display layer 36 to form a single, blended image for display on display device 20 within WCD 10.

Upon reading in tile 60A in overlay layer 40, MDP 26 reads status of current tile 60A and status of adjacent tiles recorded in the header of current tile 60A. The status may comprise an indicator of whether current tile 60A is substantially transparent and a number, if any, of adjacent tiles that are also substantially transparent. MDP 26 may skip processing those tiles indicated to be substantially transparent, and update display image 38 based only on the corresponding tiles in video display layer 36. MDP 26 may then read in the next non-transparent tile.

For example, if the current tile status indicates that current tile 60A is transparent and that two adjacent tiles are also transparent, MDP 26 may skip processing current tile 60A and the two adjacent tiles in the overlay layer. For each of the transparent tiles in overlay layer 40, MDP 26 reads corresponding tiles in video display layer 36 and sends the video display layer tiles to display buffer 28 until ready to update display image 38. MDP 26 then reads in the third non-transparent adjacent tile in overlay layer 40 for processing. MDP 26 blends the non-transparent overlay layer tile with a corresponding tile in video display layer 36 and sends the combined tile to display buffer 28 until ready to update display image 38. Therefore, when multiple substantially transparent tiles are adjacent to one another in overlay layer 40, MDP 26 only needs to read the header of the first tile to determine the number of substantially transparent tiles. In the case where current tile 60A is substantially transparent, but no adjacent tiles are substantially transparent, MDP 26 reads in the next tile adjacent current tile 60A by default after sending the video layer tile corresponding to current tile 60A to display buffer 28.

In this way, MDP 26 only needs to process a portion of plurality of tiles 60 in overlay layer 40, which reduces the amount of bandwidth required to read overlay layer 50 from memory 22 into MDP 26 according to the high change rate. In the case where overlay layer 15 is a typically sized overlay layer, approximately 80% of the plurality of tiles 60 in overlay layer 40 is substantially transparent. MDP 26 may then read the status of current and adjacent tiles in the headers of plurality of tiles 60 and skip processing 80% of plurality of tiles 60 based on the tile transparency indications.

Skipping processing of the substantially transparent tiles in overlay layer 40 reduces the approximately 35 MBps required to read overlay layer 40 from memory 22 into MDP 26 at 30 frames per second by 80% to approximately 7 MBps. Therefore, recording transparency status into headers of tiles 60 in overlay layer 40 using overlay module 24 and selectively processing only non-transparent tiles in overlay layer 40 further reduces the bandwidth required to update display image 38 according to a high rate of change using overlay layer 40 from approximately 54 MBps to approximately 26 MBps.

Overlay module 24 may also perform RLE on at least a portion of tiles 60 in overlay layer 40. For example, overlay module 24 may perform RLE on tile 60A to compress tile 60A for efficient storage in memory 22. Overlay module 24 then records the type of compression used for tile 60A in the header of tile 60A. The compression types may include, for example, component basis compression or pixel basis compression. Alternatively, in some embodiments, no compression may be used.

Overlay module 24 may compress tile 60A based on the compression type that provides the most efficient storage for tile 60A in memory 22. In some cases, tile 60A may be stored most efficiently uncompressed. The maximum storage size of tile 60A is the data size of tile 60A plus the header size of tile 60A.

In this way, MDP 26 may read compressed tiles 60 in overlay layer 40 from memory 22, and decompress tiles 60 for processing based on the compression type recorded in the headers of tiles 60. The burden on overlay layer 24 to compress the portion of tiles 60 is fairly low. Since the burden is so low, overlay layer 24 may implement lossy compression schemes that enable greater gains when the known target is MDP 26.

Figure 8A:
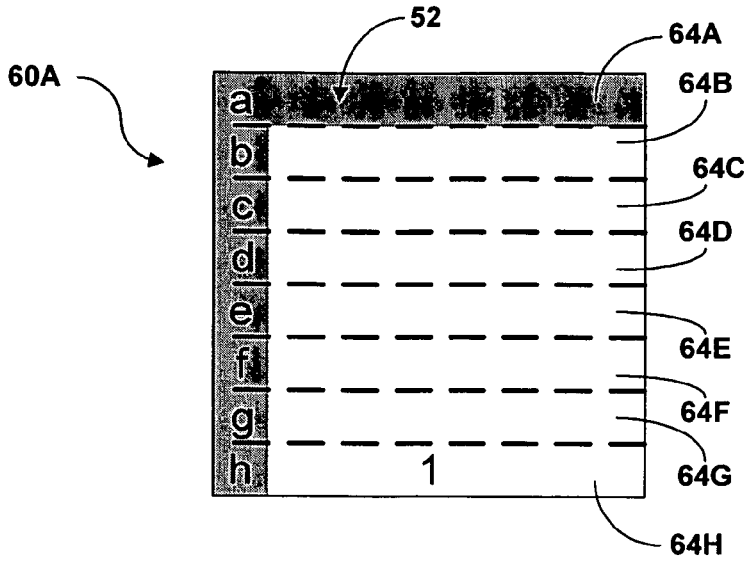
FIG. 8A illustrates pixel strips of the single tile in the overlay layer from FIG. 5.

FIG. 8A illustrates pixel strips 64A-64H ("pixel strips 64") of tile 60A in overlay layer 40. Pixel strips 64 are rows of pixels within tile 60A. In FIG. 8A, the lowercase letters "a" through "h" represent pixel strips 64 that make up tile 60A. For purposes of illustration, FIG. 8A shows tile 60A as having 8 pixel strips 64. However, a VGA sized overlay layer typically has tiles that include 16 pixel strips or 32 pixel strips.

MDP 26 reads tile 60A from memory 22 in a strip-by-strip fashion. Each of pixel strips 64 are stored in successive memory locations in memory 22. Memory controller 23 may operate most efficiently when reading in bursts of data from successive memory locations. For example, memory controller 23 may operate most efficiently when transferring bursts of 32 bytes, see Table 2 above. In one example, a pixel strip of a typical tile is 64 bytes, with 16 pixels at 4 bytes per pixel. Therefore, the pixel strip may be read from memory 22 to MDP 26 in two of the most efficient transfers.

Conventionally, a pixel strip "a" and a pixel strip "b" of a tile are stored in memory locations that are separated from one another by a "line stride." A line stride refers to the number of bytes that it takes to represent a line. In this case, if the tile is compressed using RLE, the compressed pixel strips will be separated in the memory by the line stride. This storage technique has several drawbacks. First, typical compression ratios for RLE are around four to one. Therefore, instead of fetching a pixel strip in two very efficient bursts of 32 bytes, as described above, a MDP would fetch the pixel strip in one inefficient burst of 16 bytes. A second drawback is that the run lengths of the pixel strips are limited to either 16 pixels or 32 pixels. Another drawback is that the MDP does not know how many bursts to perform to read in tile 60A until after processing the first burst, which results in increased latency when processing tile 60A for display.

Figure 8B:
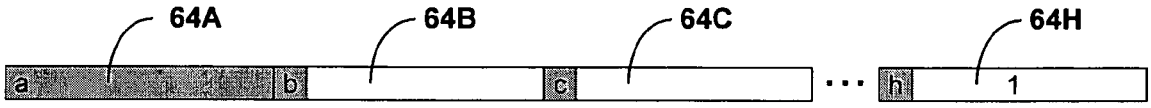
FIG. 8B illustrates the pixel strips of the single tile from FIG. 5 stored in successive memory locations that are not separated by line strides in a memory.

FIG. 8B illustrates pixel strips 64 of tile 60A stored in successive memory locations that are not separated by line strides in memory 22. In this case, overlay module 24 may perform efficient RLE on tile 60A with no run length limits for pixel strips 64. Overlay module 24 then stores compressed pixel strips 64 in order from pixel strip "a" 64A to pixel strip "h" 64H in memory 22 without line strides. Overlay module 24 also records the type of compression for tile 60A in the header of tile 60A in memory 22. MDP 26 may then read pixel strips 64 of tile 60A from memory 22 in continuous, efficient bursts of 32 bytes or 64 bytes.

Overlay module 24 may also record the burst length of the next tile, or the next non-transparent tile, in overlay layer 40 in the header of first tile 60A. In this way, MDP 26 may determine ahead of time how many bursts to perform to read the next tile from memory 22, which reduces latency when processing overlay layer 40 for display.

Storing pixel strips of tiles 60 in overlay layer 40 in successive memory location in memory 22 not separated by line strides enables overlay module 24 to efficiently compress plurality of tiles 60 to 25% of their original size. Compressing tiles 60 in overlay layer 40 reduces the approximately 7 MBps required to read overlay layer 40 from memory 22 into MDP 26 at 30 frames per second by 75% to approximately 2 MBps. Therefore, reordering the storage of pixel strips of tiles 60 in overlay layer 40 and compressing tiles 60 in memory 22 reduces the bandwidth required to update display image 38 using overlay layer 40 according to a high rate of change from approximately 26 MBps to approximately 21 MBps.

As shown in FIGS. 5 and 6, overlay layer 40 includes multiple display items, including decorative border 52, signal strength indicator 54, and video control buttons 56. Decorative border 52 does not change during display of the decoded video. Signal strength indicator 54 located in tile number three of overlay layer 40 changes anytime the signal strength received by WCD 10 changes. Video control buttons 56 located in tiles 13, 14 and 15 also do not change not change during display of the decoded video. However, video control buttons 56 may include a video counter that changes as the decoded video progresses, e.g., once per second. Therefore, the display items in overlay layer 40 that do change during display of the decoded video are relatively small and localized to a small sub-set of one or more tiles 60.

Conventionally, a software module in a WCD may compress tiles in a display layer using RLE to save memory in the WCD. In this case, the software module may compress each of the tiles differently and store the tiles in records of varying size in the memory. Therefore, mapping a particular tile in the display layer to a particular address in the memory is not straight forward.

The image processing techniques described herein can reduce bandwidth used to read an image from memory 22 for display, but not necessarily save memory in WCD 10. Overlay module 24 may store plurality of tiles 60 in overlay layer 40 as fixed size records with fixed size headers in memory 22 regardless of how each of tiles 60 is compressed. The fixed size records are large enough to store an uncompressed tile. If tile 60A is compressed, the remaining portion of the fixed size record of tile 60A may either be blank or filled with junk data. Storing plurality of tiles 60 in fixed size records ensures that each of tiles 60 has a static start and end storage point within memory 22. In this way, each of tiles 60 in overlay layer 40 may be mapped to a specific address in memory 22.

Overlay module 24 updates overlay layer 40 based on the low change rate display layers 30, 32 and 34 according to a low change rate, e.g., 1 frame per second. To update overlay layer 40, overlay module 24 reads each of the low change rate display layers 30, 32 and 34 from memory 22 and compares tiles of the low change rate display layers to overlay layer 40 to determine which of tiles 60 include changing display items. In the illustrated example from FIGS. 5 and 6, overlay module 24 may determine that tiles 3, 13, 14 and 15 include changing display items.

By storing tiles 60 in overlay layer 40 as fixed size records in memory 22, overlay module 24 can locate the changing tiles stored in memory 22 based on the specific addresses of the changing tiles in memory 22. For example, overlay module 24 knows exactly where to find tiles 3, 13, 14 and 15, or any other tile, of overlay layer 40 in memory 22. In this way, overlay module 24 only needs to update the changing tiles in overlay layer 40, which reduces the amount of bandwidth required to update overlay layer 40 according to the low change rate.

As described above, a side effect of forming overlay layer 40 with overlay module 24 is an increased amount of bandwidth required to read the low change rate display layers 30, 32 and 34 from memory 22 into overlay module 24, and then write overlay layer 40 back into memory 22. The bandwidth required to update and write overlay layer 40 with overlay module 24 at 1 frame per second is approximately 4 MBps. Updating only the changing tiles in overlay layer 40 reduces the amount of bandwidth required to update and write overlay layer 40 with overlay module 24 at 1 frame per second to approximately 1 MBps over the life of the application. Therefore, storing tiles 60 in overlay layer 40 as fixed size records in memory 22 reduces the bandwidth required to update display image 38 according to a high rate of change using overlay layer 40 from approximately 21 MBps to approximately 18 MBps.

Figure 9:
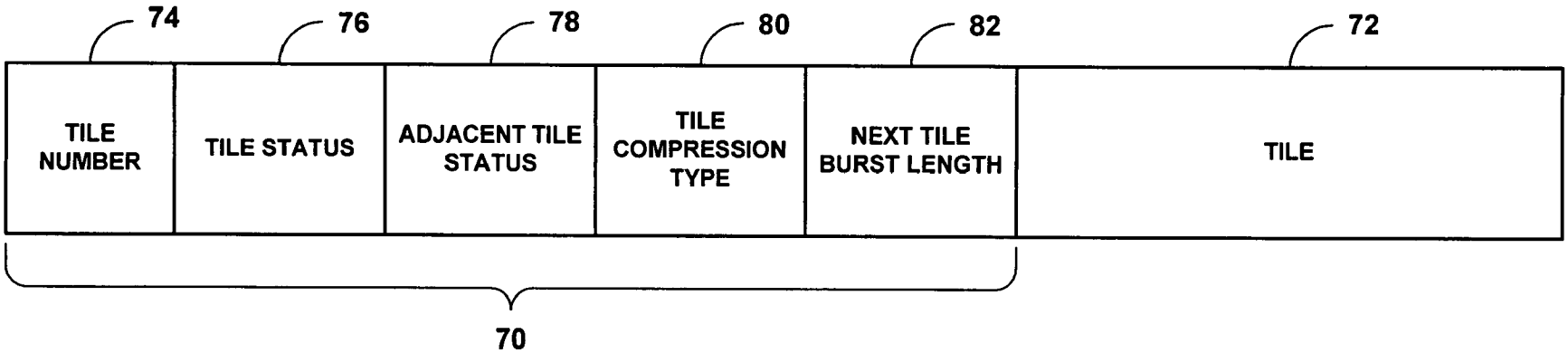
FIG. 9 illustrates a tile in an overlay layer including a header that records processing information for the tile.

FIG. 9 illustrates a tile 72 in an overlay layer including a header 70 that records processing information for tile 72. Overlay module 24 from FIG. 2 may record the processing information for tile 72 in header 70, and store tile 72 with header 70 in memory 22 from FIG. 1 via memory controller 23. In some embodiments, overlay module 24 may store tile 72 as a fixed size record in memory 22 and store header 70 of tile 72 as a fixed size header in memory 22.

Header 70 of tile 72 includes tile number 74, tile status 76, adjacent tile status 78, tile compression type 80, and next tile burst length 82. In other embodiments, header 70 of tile 72 may include more or less processing information for tile 72. Tile number 74 specifies a location of tile 72 in the overlay layer relative to the other tiles in the overlay layer. For example, an overlay layer may include approximately 1200 tiles. Tile status 76 indicates whether tile 72 is substantially transparent. Adjacent tile status 78 indicates a number of adjacent tiles to tile 72 in the overlay layer that are substantially transparency. MDP 26 may skip processing any of the tiles indicated to be substantially transparent. For example, if tile status 76 indicates that tile 72 is transparent and that two adjacent tiles are also transparent, MDP 26 may skip processing tile 72 and the two adjacent tiles and read in the third adjacent tile for processing.

Tile compression type 80 identifies a type of RLE compression for tile 72. The compression types may include component basis compression, pixel basis compression, or no compression. MDP 26 may decompress tile 72 based on the type of compression identified by tile compression type 80. Next tile burst length 82 specifies the burst length for the next tile in the overlay layer. In some cases, the burst length of the next tile may comprise the burst length of the next non-transparent tile in the overlay layer. MDP 26 may read in the next tile, or the next non-transparent tile, in the overlay layer based on the next tile burst length 82. By knowing the burst length for a tile before reading the tile, MDP 26 may reduce latency in the processing of the overlay layer.

Figure 10:
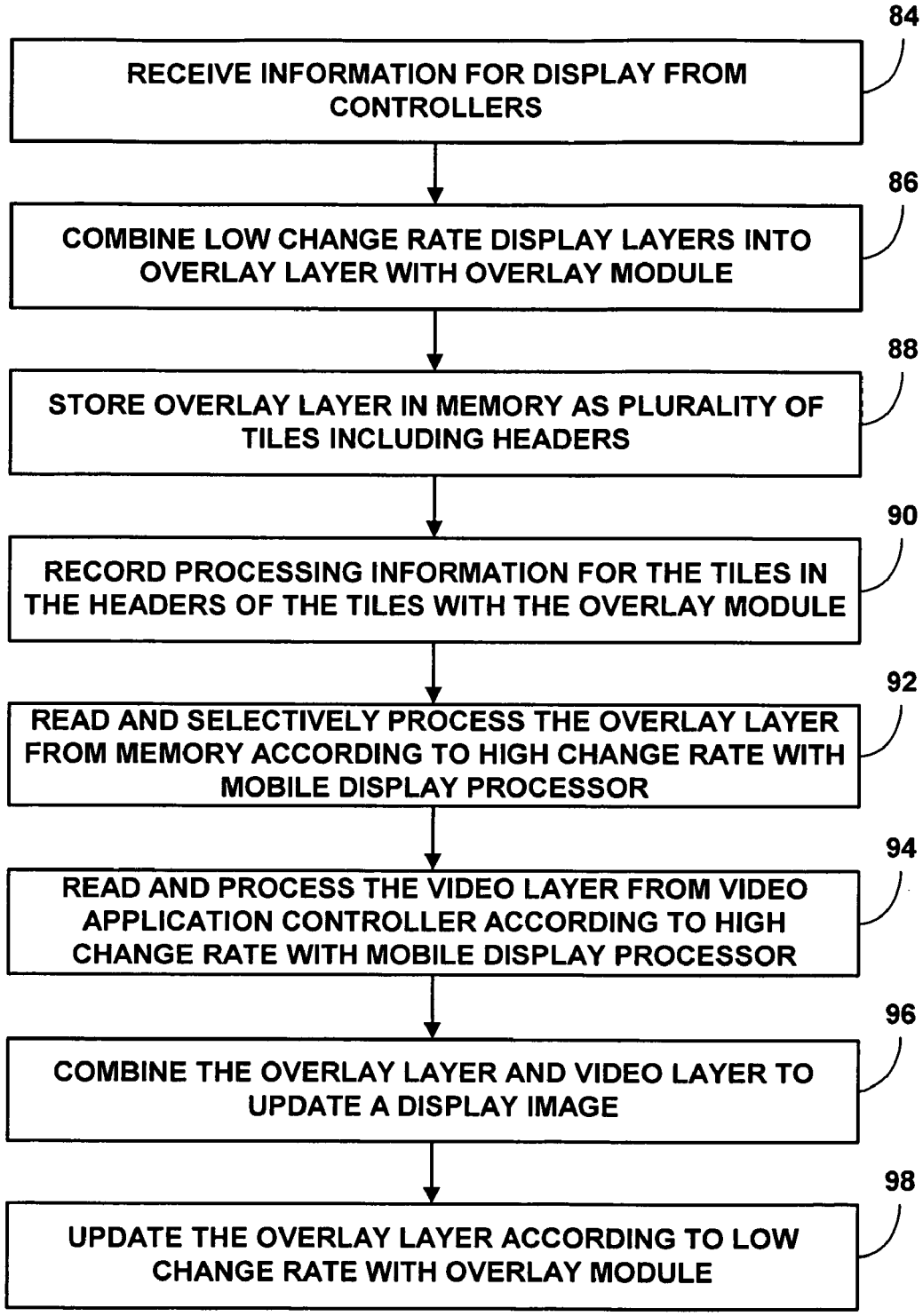
FIG. 10 is a flowchart illustrating an exemplary operation of storing an overlay layer in a memory and updating a display image according to a high rate of change using the overlay layer.

FIG. 10 is a flowchart illustrating an exemplary operation of storing an overlay layer in a memory and updating a display image according to a high rate of change using the overlay layer. The operation will be described herein in reference to MDP system 18 within WCD 10 from FIGS. 1 and 2. MDP system 18 receives information for display from system controller 12 and video application controller 14 (84). For example, MDP system 18 may receive a signal strength indicator and a clock as a system status display layer from system controller 12. MDP system 18 may also receive decoded video as a video layer, a decorative border that frames the decoded video as a border layer, and video control buttons and a video counter as a video control layer from video application controller 14.

Each of the display layers received by MDP system 18 may change at a different rate. For example, the video layer may change at a high rate, e.g., approximately 30 frames per second. The border layer may not change during display of the decoded video. The system status layer may change at a low rate, e.g., approximately 1 frame per second or when the signal strength received by WCD 10 changes. The video control layer may change at a low rate, e.g., approximately 1 frame per second, or not change during display of the decoded video. The amount of data that is changing on the system status layer and the video control layer is generally very minimal, such as the last digit of the video counter, the seconds on the time display, or the number of bars of the signal strength indicator.

Overlay module 24 combines the low change rate display layers, e.g., the border layer, the system status layer, and the video control layer, into a combined overlay layer (86). Combining the low change rate display layers into the overlay layer separate from the video layer enables overlay module 24 to update the overlay layer at a low change rate, and enables MDP 26 to process the overlay layer, instead of multiple separate display layers, with the video layer at the high rate of change. Overlay layer 24 then stores the overlay layer in memory 22 via memory controller 23 as a plurality of tiles including headers (88).

Overlay module 24 records processing information for the tiles in the headers of the tiles in memory 22 (90). For example, a header of a current tile may include the tile number of the current tile in the overlay layer, a tile status that indicates transparency of the current tile, and adjacent tile status that indicates transparency of a number of adjacent tiles in the overlay layer.

MDP 26 reads the overlay layer from memory 22 and reads the processing information recorded in the headers of the tiles in the overlay layer. MDP 26 then selectively processes the overlay layer based on the processing information according to a high rate of change (92). MDP 26 reads in the video display layer from video application controller 14 and processes the video display layer according to the high rate of change (94). Once the tiles in the video layer and the overlay layer are processed, MDP 26 combines each of the non-transparent tiles in the overlay layer with a corresponding tile in the video layer to update an image for display on display device 20 in WCD 10 (96).

In this way, MDP 26 may read the overlay layer from memory 22 instead of individual low change rate display layers, which reduces an amount of bandwidth required to read the display layers into MDP 26. In addition, recording processing information in the headers of the tiles in the overlay layer enables MDP 26 to selectively process the tiles in the overlay layer, which further reduces the amount of bandwidth required to read the overlay layer into MDP 26.

Overlay module 24 then updates the overlay layer based on the low change rate display layers from system controller 12 and video application controller 14 according a low rate of change (98). Overlay module 24 reads the individual low change rate display layers from memory 22 and merges the low change rate display layers to form an updated overlay layer. Overlay module 24 updates the overlay layer according to a low change rate of the low change rate display layers, e.g., approximately 1 frame per second. In this way, overlay module 24 substantially reduces the bandwidth required by MDP 26 to read in and update the display image from memory 22, while only slightly increasing the bandwidth required by overlay module 24 to update the overlay layer.

Figure 11:
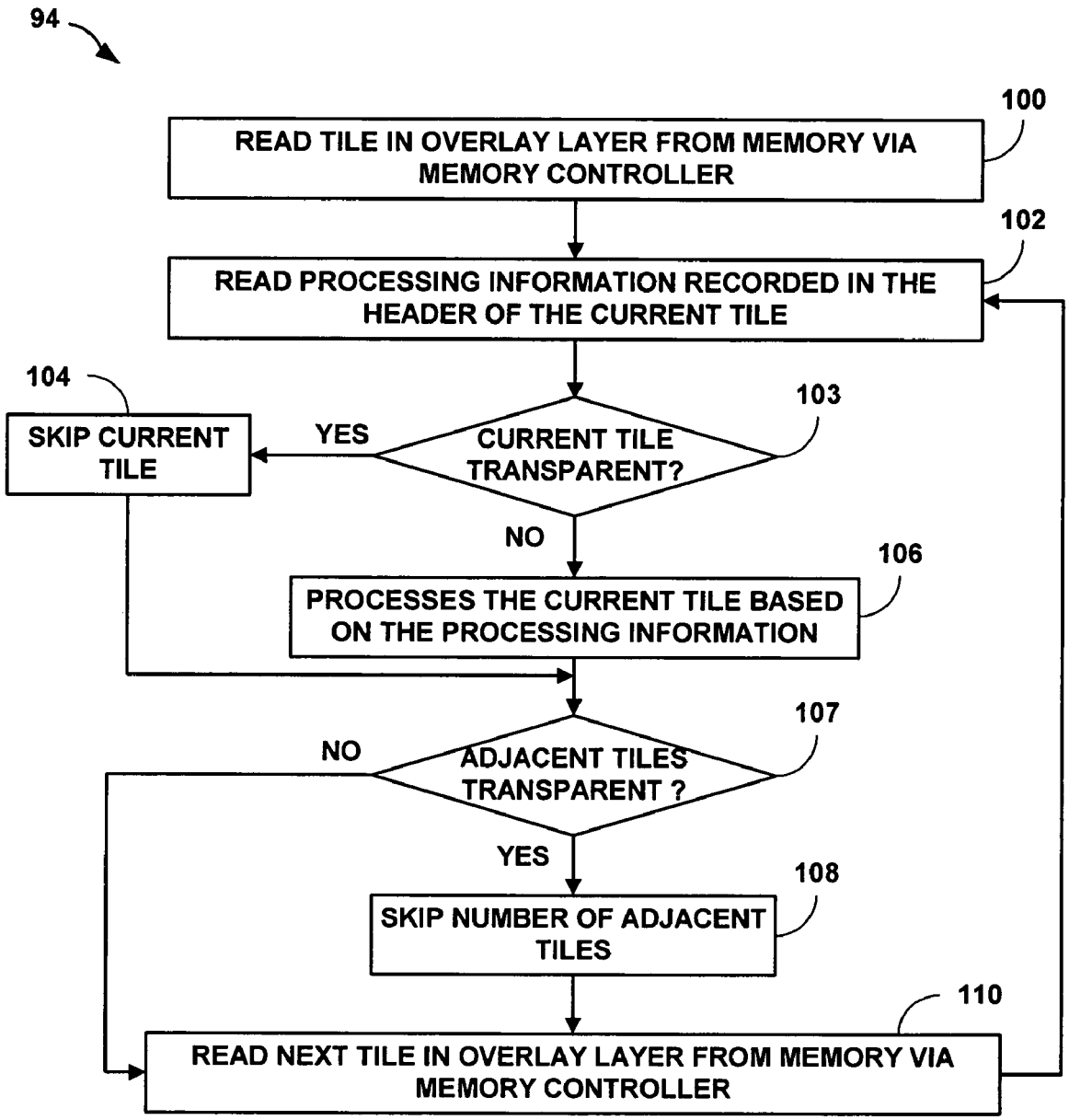
FIG. 11 is a flowchart illustrating an exemplary operation of selectively processing an overlay layer according to a high rate of change to update a display image.

FIG. 11 is a flowchart illustrating an exemplary operation of selectively processing an overlay layer according to a high rate of change to update a display image. For example, the operation may comprise step 94 from FIG. 10 in greater detail. The operation will be described herein in reference to MDP system 18 within WCD 10 from FIGS. 1 and 2.

MDP 26 reads a tile in the overlay layer from memory 22 via memory controller 23 (100). As described above, the tile includes a header that stores processing information for the tile. MDP 26 reads the processing information for the current tile recorded in the header of the current tile (102). If the current tile is not substantially transparent (no branch of 103), MDP 26 processes the current tile based on the processing information (106). In this case, MDP 26 may blend the current overlay layer tile and a corresponding tile in the video display layer to update a display image. If the current tile is substantially transparent (yes branch of 103), MDP 26 skips processing the current tile (104). In this case, the current tile in the overlay layer does not include any display items and, therefore, does not need to be updated in the display image. MDP 26 may update the display with a corresponding tile in the video display layer.

MDP 26 determines if any adjacent tiles in the overlay layer are substantially transparent (107). If a number of adjacent tiles are substantially transparent, MDP 26 skips processing that number of adjacent tiles in the overlay layer (108). In this case, the number of adjacent tiles in the overlay layer do not include any display items and, therefore, do not need to be updated in the display image. MDP 26 may update the display image with corresponding tiles in the video display layer for each of the number of adjacent tiles in the overlay layer. MDP 26 then reads the next tile in the overlay layer after the number of transparent tiles from memory 22 via memory controller 23 (110). If no adjacent tiles are substantially transparent, MDP 26 reads the next tile in the overlay layer after the current tile from memory 22 via memory controller 23 (110). In either case, MDP 26 then continues to selectively process the next tile according to the operation described herein.

Figure 12:
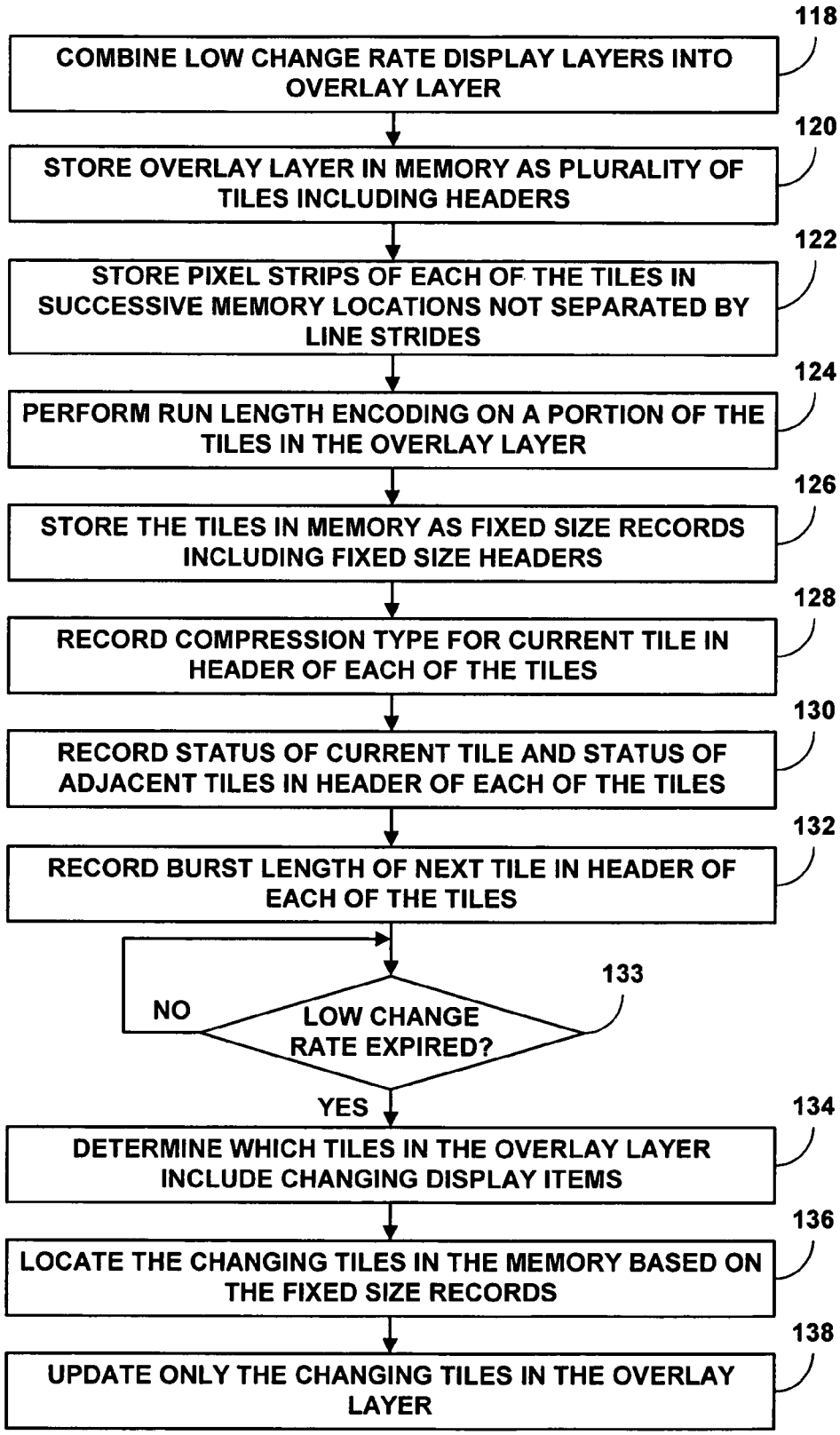
FIG. 12 is a flowchart illustrating an exemplary operation of storing and updating an overlay layer in a memory of a WCD.

FIG. 12 is a flowchart illustrating an exemplary operation of storing and updating an overlay layer in a memory of a WCD. The operation will be described herein in reference to overlay module 24 within WCD 10 from FIGS. 1 and 2. Overlay module 24 combines low change rate display layers from system controller 12 and video application controller 14 into a single overlay layer (118). Overlay module 24 then stores the overlay layer in memory 22 as a plurality of tiles including headers (120).

As described above, a VGA sized overlay layer typically includes approximately 1200 tiles, i.e., 40 tiles by 30 tiles. Each of the tiles may comprise a 16-by-16 block of pixels or a 32-by-32 block of pixels. Each row of pixels in a tile is referred to as a "pixel strip". Overlay module 24 stores pixel strips of each of the tiles in successive memory locations that are not separated by line strides within memory 22 (122). Overlay module 24 then performs RLE on at least a portion of the plurality of tiles in the overlay layer (124). Overlay module 24 may determine a compression type for each of the tiles in the overlay layer based on the most efficient storage technique for the given tile. For example, overlay module 24 may perform either pixel basis compression or component basis compression on the tiles in the overlay layer. In some cases, overlay module 24 may perform no compression.

Overlay module 24 stores the plurality of tiles in the overlay layer as fixed size records including fixed size headers in memory 22 (126). The fixed size records are large enough to store an uncompressed tile. If a tile is compressed, the remaining portion of the fixed size record of the tile may either be blank or filled with junk data. Storing the plurality of tiles in fixed size records ensures that each tile has a static start and end storage point within memory 22. In this way, each of the tiles in the overlay layer may be mapped to a specific address in memory 22.

Overlay module 24 then records processing information for the plurality of tiles into the headers of the tiles. For example, overlay module 24 records a compression type, e.g., pixel basis, component basis, or none, for a current tile in the header of the current tile for each of the plurality of tiles in the overlay layer (128). In this way, MDP 26 may read the compression type from the header to determine whether to decompress a current tile and, if decompression is need, what decompression technique to use. Overlay module 24 also records the status of a current tile and the status of adjacent tiles in the header of the current tile (130). In other words, the header of each of the plurality of tiles includes an indication of whether the current tile is transparent. The header of each of the plurality of tiles also includes an indication of whether a number of tiles adjacent to the current tile are transparent. In this way, MDP 26 may read the current and adjacent tile status from the header and skip processing one or more tiles in the overlay layer based on the status information.

Overlay module 24 also records the burst length for a next tile in the header of a current tile for each of the plurality of tiles in the overlay layer (132). In some cases, the next tile may comprise the next non-transparent tile in the overlay layer. In this way, MDP 26 may read the next tile burst length from the header to determine the most efficient way to read in the next tile. Knowing how many efficient bursts to perform to read in the data for the next tile before processing a first burst of the next tile may substantially reduce latency when processing the overlay layer for display.

Once the overlay layer is properly stored in memory 22, overlay module 24 updates the overlay layer based on the low change rate display layers at a low change rate, e.g., 1 time per second. When the low change rate expires (133), overlay module 24 determines which of the plurality of tiles in the overlay layer include changing display items (134). For example, overlay module 24 may read each of the low change rate display layers from memory 22 and compare tiles of the low change rate display layers to the overlay layer to determine which of the tiles in the overlay layer include changing display items.

By storing the tiles in the overlay layer as fixed size records in memory 22, overlay module 24 locates the changing tiles stored in memory 22 based on the specific addresses of the fixed size records in memory 22 (136). Overlay module 24 then updates only the changing tiles in the overlay layer and stores the updated overlay layer in memory 22 (138). Typically, the changing display items are located in a small sub-set of the plurality of tiles in the overlay layer, which reduces the amount of bandwidth required to update the overlay layer with overlay module 24 according to the low change rate.

Figure 13A:
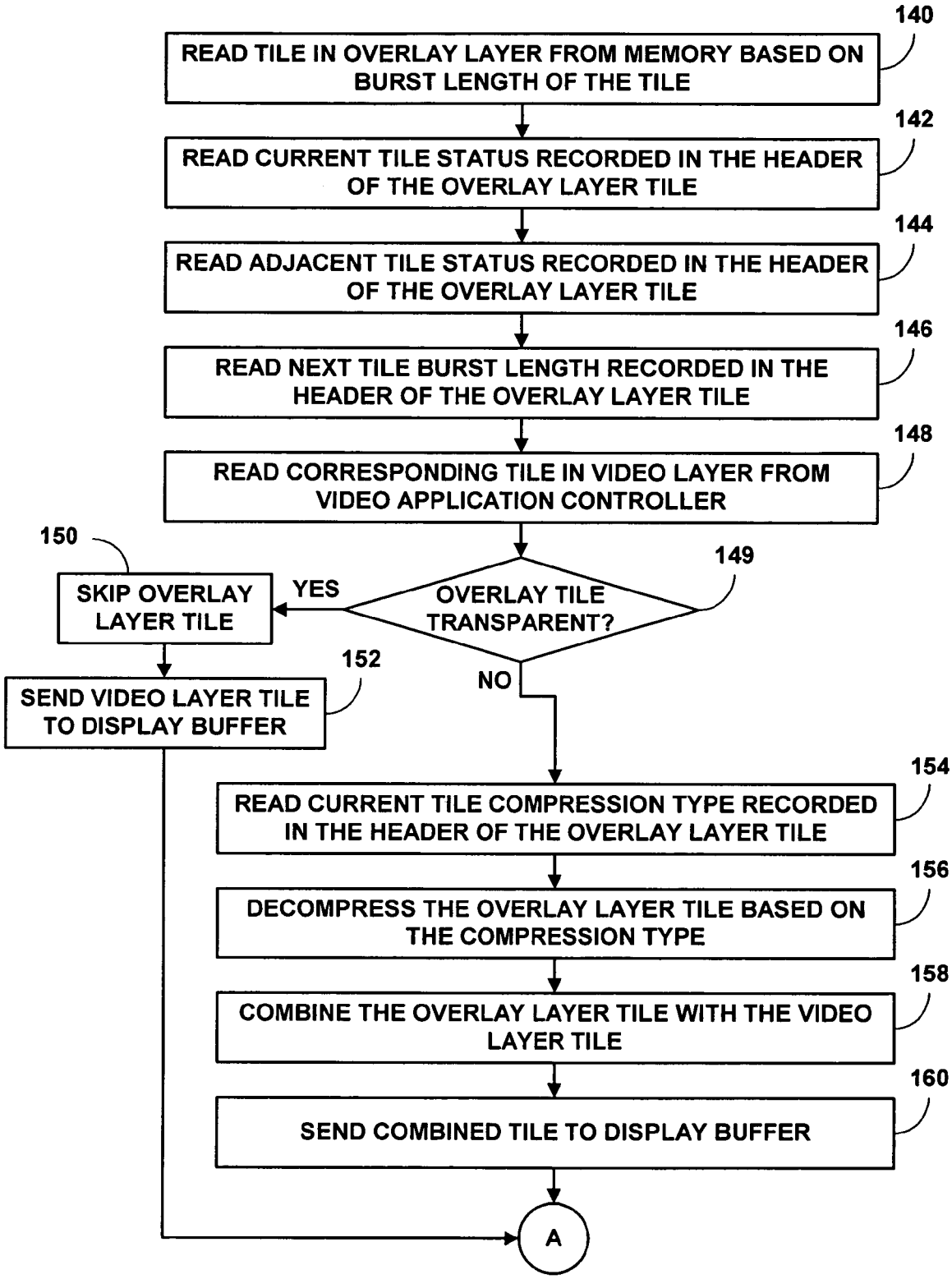
FIGS. 13A and 13B are flowcharts illustrating an exemplary operation of updating a display image according to a high rate of change using an overlay layer.
Figure 13B:
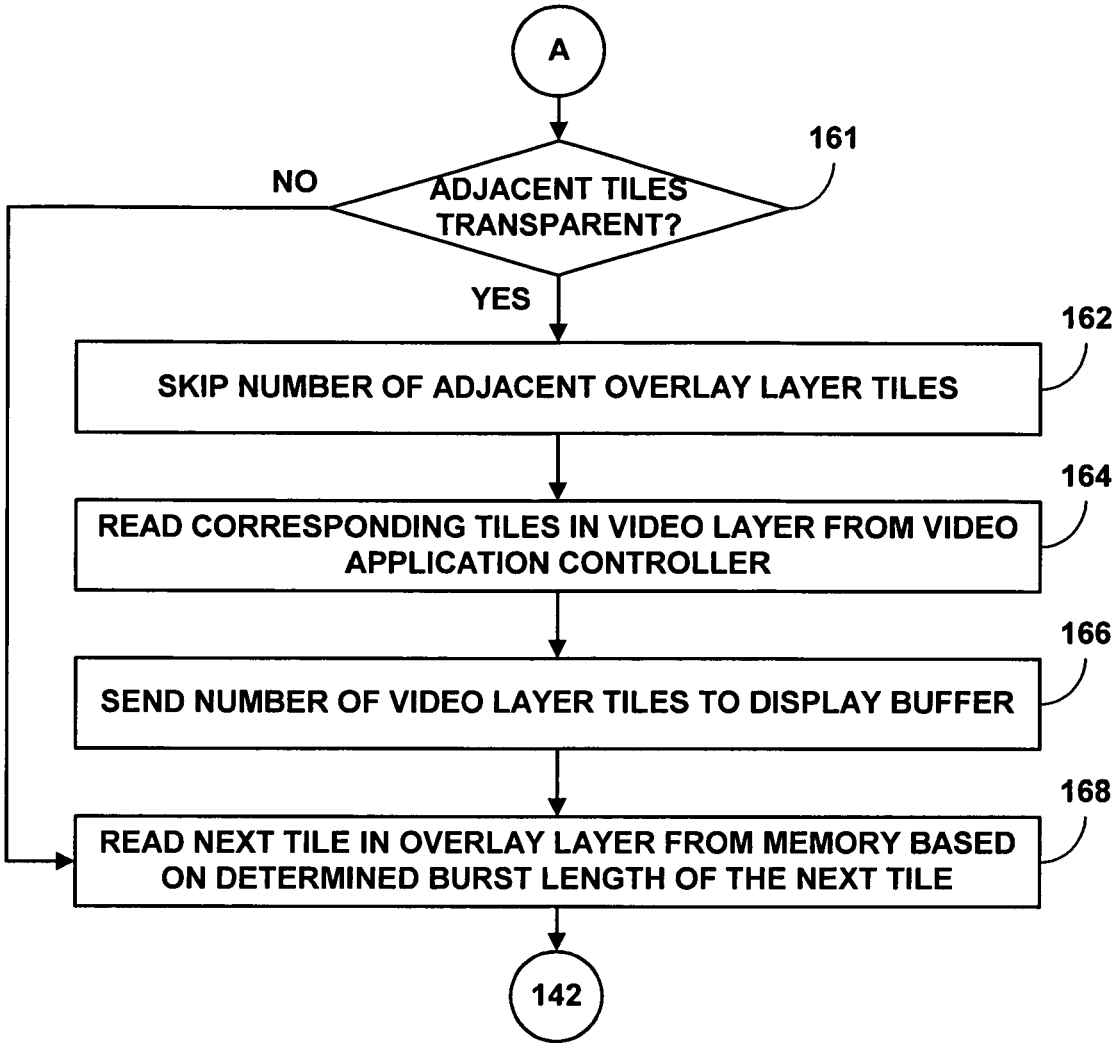

FIGS. 13A and 13B are flowcharts illustrating an exemplary operation of selectively updating a display image according to a high rate of change using an overlay layer. The operation will be described herein in reference to MDP 26 within WCD 10 from FIGS. 1 and 2. MDP 26 reads a tile in the overlay layer from memory 22 based on a burst length of the current tile, if known (140).

As described above, the tile includes a header that stores processing information for the tile. As shown in FIG. 13A, MDP 26 reads a current tile status recorded in the header of the overlay layer tile that indicates whether the overlay layer tile is substantially transparent (142). MDP 26 also reads an adjacent tile status recorded in the header of the overlay layer tile that indicates a number of adjacent overlay layer tiles in the overlay layer that are substantially transparent (144). In addition, MDP 26 reads a next tile burst length recorded in the header of the overlay layer tile that specifies a most efficient burst length to read in the next tile, or next non-transparent tile, from memory 22 (146). MDP 26 then reads a corresponding tile in a video display layer from video application controller 14 (148).

MDP 26 determines whether the overlay layer tile is substantially transparent based on the tile status read from the header of the overlay layer tile (149). If the overlay layer tile is not substantially transparent, MDP 26 reads the current tile compression type recorded in the header of the overlay layer tile that identifies the type of compression, if any, used to RLE the overlay layer tile (154). The compression types may include component basis compression, pixel basis compression, or no compression. MDP 26 then decompresses the overlay layer tile based on the compression type for the overlay layer tile (156). In this way, if the current tile is compressed, MDP 26 may determine what decompression technique to use for the current tile. MDP 26 combines the overlay layer tile with the corresponding video layer tile to form a display image tile (158). MDP 26 sends the combined tile to display buffer 28 until ready to update the display image on display device 20 (160).

If the overlay layer tile is substantially transparent, MDP 26 skips processing the overlay layer tile (150). In this case, the current tile in the overlay layer does not include any display items and, therefore, does not need to be updated in the display image. MDP 26 sends the corresponding video layer tile to display buffer 28 until ready to update the display image on display device 20 (152).

As shown in FIG. 13B, MDP 26 then determines if any adjacent overlay layer tiles in the overlay layer are substantially transparent based on the adjacent tile status read from the header of the overlay layer tile (161). If a number of adjacent tiles are substantially transparent, MDP 26 skips processing that number of adjacent tiles in the overlay layer (162). MDP 26 then reads corresponding tiles in the video display layer from video application controller 14 for each of the number of transparent adjacent overlay layer tiles (164). MDP 26 sends the number of corresponding video layer tiles to display buffer 28 until ready to update the display image on display device 20 (166). MDP 26 then reads the next tile in the overlay layer after the number of transparent overlay layer tiles from memory 22 based on the burst length of the next tile (168).

If no adjacent overlay layer tiles are substantially transparent, MDP 26 reads the next tile in the overlay layer after the current overlay layer tile from memory 22 based on the burst length of the next tile (168). In either case, MDP 26 then continues to selectively process the next tile according to the operation described herein. In this way, an amount of bandwidth required to read the display layers from memory 22 into MDP 26 to update the display image on display device 20 is substantially reduced.

A number of embodiments have been described. However, various modifications to these embodiments are possible, and the principles presented herein may be applied to other embodiments as well. Methods as described herein may be implemented in hardware, software, and/or firmware. The various tasks of such methods may be implemented as sets of instructions executable by one or more arrays of logic elements, such as microprocessors, embedded controllers, or processor cores. In one example, one or more such tasks are arranged for execution within a mobile station modem chip or chipset that is configured to control operations of various devices of a personal communications device such as a cellular telephone.

The techniques described in this disclosure may be implemented within a general purpose microprocessor, digital signal processor (DSP), application specific integrated circuit (ASIC), field programmable gate array (FPGA), or other equivalent logic devices. The term "processor" or "processing circuitry" may generally refer to any of the foregoing logic circuitry, alone or in combination with other logic circuitry, or any other equivalent circuitry. In some embodiments, the functionality described herein may be provided within dedicated software modules or hardware units configured for encoding and decoding, or incorporated in a combined video encoder-decoder (CODEC). If implemented in software, the techniques may be embodied as instructions on a computer-readable medium such as random access memory (RAM), read-only memory (ROM), non-volatile random access memory (NVRAM), electrically erasable programmable read-only memory (EEPROM), FLASH memory, or the like. The instructions cause one or more processors to perform certain aspects of the functionality described in this disclosure.

As further examples, an embodiment may be implemented in part or in whole as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a microprocessor or other digital signal processing unit. The data storage medium may be an array of storage elements such as semiconductor memory (which may include without limitation dynamic or static RAM, ROM, and/or flash RAM) or ferroelectric, ovonic, polymeric, or phase-change memory; or a disk medium such as a magnetic or optical disk.

In this disclosure, various techniques have been described. For example, image processing techniques are described that reduce the amount of bandwidth used to read an image from a memory for display. The image processing techniques include blending low change rate display layers into a combined overlay layer and storing the overlay layer in a memory as a plurality of tiles including headers. The overlay layer may be stored in the memory such that a processor can read the display layers from the memory using a reduced amount of processing resources.

For example, a MDP reads the overlay layer from the memory and selectively processes the plurality of tiles in the overlay layer based on the processing information recorded in the headers according to a high change rate. The MDP also reads in and processes a video display layer according to the high change rate. The MDP blends each non-transparent tile in the overlay layer with a corresponding tile in the high change rate display layer to update a display image on a display device. In this way, the amount of bandwidth required to read the display layer from the memory into the MDP and update the display image according to the high change rate is reduced.

In addition, the image processing techniques enable an overlay module to update the overlay layer based on the low change rate display layers according to a low change rate. The overlay module may update only the changing tiles in the overlay layer. In this way, the amount of bandwidth required to update the overlay layer with the overlay module according to the low change rate is reduced.

Although described primarily in reference to processing images for display in wireless communication devices, the image processing techniques may be implemented in wired communication devices or other devices such as display devices, which may or may not support communication. These and other embodiments are within the scope of the following claims.

The invention claimed is:

1. A method comprising:

combining, using a processor of a display processor system, two or more display layers to form an overlay layer;

storing the overlay layer in a memory of the display processor system as a plurality of tiles including headers;

recording processing information for each of the plurality of tiles in the headers of the respective tiles stored in the memory;

selectively processing, using the processor of the display processor system, the overlay layer based on processing information for the overlay layer recorded in the memory wherein selectively processing the overlay layer comprises selectively processing the plurality of tiles in the overlay layer based on the processing information recorded in the headers of the plurality of tiles and wherein selectively processing the plurality of tiles comprises reading a burst length for a next tile in the overlay layer in a header of a current tile;

reading the next tile from the memory according to the burst length for the next tile;

combining, using the processor of the display processor system, the overlay layer with a video layer to form an image for presentation on a display device;

updating, using the processor of the display processor system, the image at a first change rate corresponding to a change rate associated with the video layer; and updating, using the processor of the display processor system, the overlay layer at a second change rate lower than the first change rate.

2. The method of claim 1, wherein updating the image comprises:

reading the overlay layer from the memory;

selectively processing the overlay layer based on the processing information for the overlay layer recoded in the memory; and recombining the overlay layer with the video layer according to the first change rate.

3. The method of claim 1, wherein updating the overlay layer comprises:

reading the two or more display layers from the memory; and recombining the display layers according to the second change rate.

4. The method of claim 1, wherein recording processing information in headers comprises recording one or more of a current tile status that indicates whether the current tile is substantially transparent, an adjacent tile status that indicates a number of adjacent tiles in the overlay layer that are substantially transparent, and a compression type for the current tile.

5. The method of claim 1, further comprising:

reading the overlay layer from the memory on a tile-by-tile basis; and reading the processing information recorded in the headers of the plurality of tiles.

6. The method of claim 1, wherein selectively processing the plurality of tiles comprises skipping processing at least a portion of the plurality of tiles in the overlay layer based on the processing information recorded in the headers of the plurality of tiles.

7. The method of claim 1, wherein selectively processing the plurality of tiles comprises:

determining whether a current tile in the overlay layer is substantially transparent based on a current tile status recorded in the header of the current tile; and skipping processing the current tile when the current tile is determined to be substantially transparent.

8. The method of claim 7, wherein selectively processing the plurality of tiles comprises:

determining a number of adjacent tiles to the current tile in the overlay layer that are substantially transparent based on an adjacent tile status recorded in the header of the current tile; and skipping processing the number of adjacent tiles in the overlay layer.

9. The method of claim 1, wherein storing the overlay layer comprises:

compressing at least a portion of the plurality of tiles in the overlay layer according to a compression type for each of the tiles; and recording the compression type for each of the tiles in the headers of the respective tiles.

10. The method of claim 9, wherein compressing at least a portion of the plurality of tiles comprises performing run-length encoding on the plurality of tiles, and wherein the compression types include pixel basis compression, component basis compression, or no compression.

11. The method of claim 9, wherein selectively processing the overlay layer further comprises:

reading a compression type for a current tile recorded in a header of the current tile; and decompressing the current tile according to the compression type for the current tile.

12. The method of claim 1, wherein storing the overlay layer comprises storing pixel strips of each of the plurality of tiles in successive memory locations not separated by line strides in the memory.

13. The method of claim 12, wherein storing the overlay layer comprises performing run-length encoding on at least a portion of the plurality of tiles in the overlay layer with unlimited pixel strip run lengths for each of the plurality of tiles.

14. The method of claim 1, wherein storing the overlay layer comprises storing each of the plurality of tiles in fixed size records including fixed size headers in the memory.

15. The method of claim 14, wherein updating the overlay layer comprises:

determining which of the plurality of tiles in the overlay layer include changing display items;

locating the changing tiles in the memory based on the fixed size records; and updating only the changing tiles in the overlay layer.

16. A computer-readable storage medium storing code for causing a computer to:

combine two or more display layers to form an overlay layer;

store the overlay layer in a memory as a plurality of tiles including headers;

record processing information for each of the plurality of tiles in headers of the respective tiles;

selectively process the overlay layer based on processing information for the overlay layer recorded in memory, wherein to selectively process the overlay layer, the instructions cause the computer to selectively process the plurality of tiles in the overlay layer based on the processing information recorded in the headers of the plurality of tiles, to read a burst length for a next tile in the overlay layer in a header of a current tile, and to read the next tile from the memory according to the burst length for the next tile;

combine the overlay layer with a video layer to form an image for presentation on a display device;

update the image at a first change rate corresponding to a change rate associated with the video layer; and update the overlay layer at a second change rate lower than the first change rate.

17. The computer-readable storage medium of claim 16, further comprising code for causing a computer to:

read the overlay layer from the memory;

selectively process the overlay layer based on the processing information for the overlay layer recoded in the memory; and recombine the overlay layer with the video layer to update the image according to the first change rate.

18. The computer-readable storage medium of claim 16, further comprising code for causing a computer to:

read the two or more display layers from the memory; and recombine the display layers to update the overlay layer according to the second change rate.

19. The computer-readable storage medium of claim 16, further comprising code for causing a computer to:

read the overlay layer from the memory on a tile-by-tile basis; and read the processing information recorded in the headers of the plurality of tiles.

20. The computer-readable storage medium of 16, further comprising code for causing computer to:

skip processing at least a portion of the plurality of tiles in the overlay layer based on the processing information recorded in the headers of the plurality of tiles.

21. The computer-readable storage medium of claim 16, further comprising code for causing computer to:

determine whether a current tile in the overlay layer is substantially transparent based on a current tile status recorded in the header of the current tile;

skip processing the current tile when the current tile is determined to be substantially transparent;

determine a number of adjacent tiles to the current tile in the overlay layer that are substantially transparent based on an adjacent tile status recorded in the header of the current tile; and skip processing the number of adjacent tiles in the overlay layer.

22. The computer-readable storage medium of claim 16, further comprising code for causing a computer to:

compress at least a portion of the plurality of tiles in the overlay layer according to a compression type for each of the tiles;

record the compression type for each of the tiles in the headers of the respective tiles;

read a compression type for a current tile recorded in a header of the current tile; and decompress the current tile according to the compression type for the current tile.

23. The computer-readable storage medium of claim 16, further comprising code for causing a computer to:

store pixel strips of each of the plurality of tiles in successive memory locations not separated by line strides in the memory; and perform run-length encoding on at least a portion of the plurality of tiles in the overlay layer with unlimited pixel strip run lengths for each of the plurality of tiles.

24. The computer-readable medium of claim 16, further comprising code for causing a computer to:

update the overlay layer, store each of the plurality of tiles in fixed size records including fixed size headers in the memory;

determine which of the plurality of tiles in the overlay layer include changing display items;

locate the changing tiles in the memory based on the fixed size records; and update only the changing tiles in the overlay layer.

25. A display processor system comprising:

an overlay module that combines two or more display layers to form an overlay layer; and a display processor that selectively processes the overlay layer based on processing information for the overlay layer recorded in a memory, combines the overlay layer with a video layer to form an image for presentation on a display device, and updates the image at a first change rate corresponding to a change rate associated with the video layer, wherein the overlay module updates the overlay layer at a second change rate lower than the first change rate, wherein the overlay module stores the overlay layer in the memory as a plurality of tiles including headers, and records processing information for each of the plurality of tiles in headers of the respective tiles, wherein the processor selectively processes the plurality of tiles in the overlay layer based on the processing information recorded in the headers of the plurality of tiles, and wherein the processor reads a burst length for a next tile in the overlay layer in a header of a current tile, and reads the next tile from the memory according to the burst length for the next tile.

26. The system of claim 25, wherein the processor reads the overlay layer from the memory, selectively processes the overlay layer based on the processing information for the overlay layer recoded in the memory, and recombines the overlay layer with the video, layer to update the image according to the first change rate.

27. The system of claim 25, wherein the overlay module reads the two or more display layers from the memory, and recombines the display layers to update the overlay layer according to the second change rate.

28. The system of claim 25, wherein the display layers comprise two or more of a video control layer that includes video control buttons and a video counter, a system status layer that includes a signal strength indicator and a time clock, and a border layer that includes a decorative border.

29. The system of claim 25, wherein the display layers comprise slowly changing display layers and static display layers.

30. The system of claim 25, wherein the system is included within a wireless communication device (WCD).

31. The system of claim 30, wherein the system receives the two or more display layers from at least one of a video application controller and a system controller within the WCD.

32. The system of claim 30, wherein the system receives the video layer from a video application controller within the WCD.

33. The system of claim 25, wherein the overlay module records one or more of a current tile status that indicates whether the current tile is substantially transparent, an adjacent tile status that indicates a number of adjacent tiles in the overlay layer that are substantially transparent, a compression type for the current tile, and a burst length for a next tile in the overlay layer in the headers of the plurality of tiles.

34. The system of claim 25, wherein the processor reads the overlay layer from the memory on a tile-by-tile basis, and reads the processing information recorded in the headers of the plurality of tiles.

35. The system of claim 25, wherein the processor skips processing at least a portion of the plurality of tiles in the overlay layer based on the processing information recorded in the headers of the plurality of tiles.

36. The system of claim 25, wherein the processor determines whether a current tile in the overlay layer is substantially transparent based on a current tile status recorded in the header of the current tile, and skips processing the current tile when the current tile is determined to be substantially transparent.

37. The system of claim 36, wherein the processor determines a number of adjacent tiles to the current tile in the overlay layer that are substantially transparent based on an adjacent tile status recorded in the header of the current tile, and skips processing the number of adjacent tiles in the overlay layer.

38. The system of claim 25, wherein the overlay module compresses at least a portion of the plurality of tiles in the overlay layer according to a compression type for each of the tiles, and records the compression type for each of the tiles in the headers of the respective tiles.

39. The system of claim 38, wherein the overlay layer performs run-length encoding on the plurality of tiles to compress the portion of the plurality of tiles, and wherein the compression types include pixel basis compression, component basis compression, or no compression.

40. The system of claim 38, wherein the processor reads a compression type for a current tile recorded in a header of the current tile, and decompresses the current tile according to the compression type for the current tile.

41. The system of claim 25, wherein the overlay module stores pixel strips of each of the plurality of tiles in successive memory locations not separated by line strides in the memory.

42. The system of claim 41, wherein the overlay module performs run-length encoding on at least a portion of the plurality of tiles in the overlay layer with unlimited pixel strip run lengths for each of the plurality of tiles.

43. The system of claim 25, wherein the overlay module stores each of the plurality of tiles in fixed size records including fixed size headers in the memory.

44. The system of claim 43, wherein the overlay module determines which of the plurality of tiles in the overlay layer include changing display items, locates the changing tiles in the memory based on the fixed size records, and updates only the changing tiles in the overlay layer.

45. A system comprising:

a display device;

an overlay module that combines two or more display layers to form an overlay layer; and a memory configured to store the overlay layer as a plurality of tiles including headers;

a processor that is configured to:

selectively process the overlay layer based on processing information for the overlay layer recorded in the memory, combine the overlay layer with a video layer to form an image for presentation on the display device, and update the image at a first change rate corresponding to a change rate associated with the video layer, wherein the overlay module updates the overlay layer at a second change rate lower than the first change rate, wherein to selectively process the overlay layer the processor is further configured to:

selectively process the plurality of tiles in the overlay layer based on the processing information recorded in the headers of the plurality of tiles;

determine whether a current tile in the overlay layer is substantially transparent based on a current tile status recorded in the header of the current tile, and skip processing the current tile when the current tile is determined to be substantially transparent.

46. A method of processing display data, the method comprising:

combining, using a processor of a display processor system, two or more display layers to form an overlay layer;

storing the overlay layer in a memory of the display processor system as a plurality of tiles including headers;

recording processing information for each of the plurality of tiles in the headers of the respective tiles stored in the memory;

selectively processing, using the processor of the display processor system, the overlay layer based on processing information for the overlay layer recorded in the memory;

combining, using the processor of the display processor system, the overlay layer with a video layer to form an image for presentation on a display device;

updating, using the processor of the display processor system, the image at a first change rate corresponding to a change rate associated with the video layer; and updating, using the processor of the display processor system, the overlay layer at a second change rate lower than the first change rate wherein selectively processing the overlay layer comprises:

selectively processing the plurality of tiles in the overlay layer based on the processing information recorded in the headers of the plurality of tiles, determining whether a current tile in the overlay layer is substantially transparent based on a current tile status recorded in the header of the current tile, and skipping processing the current tile when the current tile is determined to be substantially transparent.

47. A system for processing display data, the system comprising:

means for combining two or more display layers to form an overlay layer;

means for storing the overlay layer as a plurality of tiles including headers;

means for processing display data being configured to:

record processing information for each of the plurality of tiles in the headers of the respective tiles stored in the memory;

selectively process the overlay layer based on processing information for the overlay layer recorded in the memory;

combine the overlay layer with a video layer to form an image for presentation on a display device;

update the image at a first change rate corresponding to a change rate associated with the video layer; and update the overlay layer at a second change rate lower than the first change rate, wherein to selectively process the overlay layer the processing means is further configured to:

selectively process the plurality of tiles in the overlay layer based on the processing information recorded in the headers of the plurality of tiles;

determine whether a current tile in the overlay layer is substantially transparent based on a current tile status recorded in the header of the current tile, and skip processing the current tile when the current tile is determined to be substantially transparent.

* * * * *